US006129305A

United States Patent [19]

Möller et al.

[11] Patent Number: 6,129,305

[45] Date of Patent: Oct. 10, 2000

[54] PROCESS AND WINDING MACHINE FOR CONTINUOUS WINDING OF A MATERIAL WEB

[75] Inventors: Roland Möller, Herbrechtingen; Ralf Preising, Holzkirch; Rudolf Beisswanger, Steinheim; Zygmunt Madrzak, Heidenheim; Walter Kaipf, Haunsheim, all of Germany

[73] Assignee: Voith Sulzer Papiertechnik Patent GmbH, Heidenheim, Germany

[21] Appl. No.: 09/147,279

[22] PCT Filed: May 15, 1998

[86] PCT No.: PCT/EP98/02867

§ 371 Date: Nov. 18, 1998

§ 102(e) Date: Nov. 18, 1998

[87] PCT Pub. No.: WO98/52858

PCT Pub. Date: Nov. 26, 1998

[30] Foreign Application Priority Data

| | | | |
|---|---|---|---|
| May 16, 1997 | [DE] | Germany | 197 20 495 |
| Jun. 18, 1997 | [DE] | Germany | 197 25 878 |
| Aug. 15, 1997 | [DE] | Germany | 197 35 590 |
| Aug. 29, 1997 | [DE] | Germany | 197 37 709 |
| Nov. 6, 1997 | [DE] | Germany | 197 48 995 |

[51] Int. Cl.[7] ..... B65H 18/10; B65H 18/16; B65H 18/26; B65H 19/26

[52] U.S. Cl. ..... 242/541; 242/541.6; 242/541.7; 242/542.3

[58] Field of Search ..... 242/542.3, 541.4, 242/541.5, 541.6, 541.7, 541.1

[56] References Cited

U.S. PATENT DOCUMENTS

| | | | |
|---|---|---|---|
| 3,103,321 | 9/1963 | Jilek | 242/542.3 |
| 3,471,097 | 10/1969 | Phelps | 242/542.3 |
| 3,834,642 | 9/1974 | Kampf . | |
| 4,111,377 | 9/1978 | Tetro et al. | 242/542.3 |

(List continued on next page.)

FOREIGN PATENT DOCUMENTS

| | | |
|---|---|---|
| 0369977 | 5/1990 | European Pat. Off. . |
| 0483092 | 4/1992 | European Pat. Off. . |
| 0561128 | 9/1993 | European Pat. Off. . |
| 1993770 | 9/1968 | Germany . |
| 1574307 | 3/1971 | Germany . |
| 2555677 | 6/1977 | Germany . |
| 3635197 | 2/1988 | Germany . |
| 4004655 | 8/1991 | Germany . |
| 4007329 | 9/1991 | Germany . |
| 4401804 | 6/1994 | Germany . |
| 4401959 | 7/1994 | Germany . |
| 4304469 | 8/1994 | Germany . |
| 4343173 | 6/1995 | Germany . |
| 4415324 | 11/1995 | Germany . |

(List continued on next page.)

OTHER PUBLICATIONS

Patent Abstracts of Japan, M–510, Aug. 23, 1986, vol. 10, No. 246.

Patent Abstracts of Japan, M–1310, Sep. 14, 1992, vol. 16, No. 440.

*Primary Examiner*—John M. Jillions

*Attorney, Agent, or Firm*—Greenblum & Bernstein, P.L.C.

[57] ABSTRACT

Winding machine for continuous winding of a material web, in particular a paper or cardboard web, onto a reel into a winding roll, having a movable pressing drum, which forms a winding gap with the winding roll, having at least one primary transport device by means of which the reel can be moved along a first guide track, and at least one secondary transport device that guides the reel along a second guide track. To prepare for a reel change, the new reel can be shifted by the primary transport device into a reel-changing position in which a new winding gap is formed between the new reel and the pressing drum. In the reel-changing position, the material web is guided over a circumference region of the new reel.

58 Claims, 9 Drawing Sheets

U.S. PATENT DOCUMENTS

| | | | |
|---|---|---|---|
| 4,191,341 | 3/1980 | Looser . | |
| 4,979,689 | 12/1990 | Snygg | 242/542.3 |
| 5,064,131 | 11/1991 | Van Biesen et al. | 242/542.3 |
| 5,184,787 | 2/1993 | Holzinger et al. . | |
| 5,249,758 | 10/1993 | Müller et al. . | |
| 5,251,835 | 10/1993 | Kyystönen . | |
| 5,308,008 | 5/1994 | Ruegg . | |

FOREIGN PATENT DOCUMENTS

| | | |
|---|---|---|
| 19607349 | 8/1997 | Germany . |
| 4153153 | 5/1992 | Japan . |
| 2122581 | 1/1984 | United Kingdom . |
| 90/00511 | 1/1990 | WIPO . |
| 94/26641 | 11/1994 | WIPO . |
| 97/22543 | 6/1997 | WIPO . |

33

PROCESS AND WINDING MACHINE FOR CONTINUOUS WINDING OF A MATERIAL WEB

BACKGROUND OF THE INVENTION

1. Field of the Invention

The present invention relates to a process for continuous winding of a material web, in particular a paper or cardboard web, and a winding machine for continuous winding of a material web, in particular a paper or cardboard web.

2. Discussion of Background Information

Winding machines and winding processes are known (see, e.g., (EP 0 561 128 A1). They are employed, for example, at the end of a machine for manufacturing a material web and are used for continuous winding of the material web onto a reel. The known winding machine includes a horizontally movable pressing drum, also called a Pope drum, over part of whose circumference the material web is guided. The material web is wound into a winding roll on reel. During the entire winding operation, the winding roll forms a winding gap with the pressing drum. In order to prepare for a change of the reel, an empty reel is pressed against the circumference of the pressing drum to form a new winding gap. During this winding phase, the material web is guided through both the nip between the new reel and the pressing drum and the closed nip between the almost-finished winding roll and the pressing drum. Then, in the region disposed between the full winding roll and the new reel, the material web is cut directly on the pressing drum and the new web beginning is wound onto the new reel. It has proven very difficult to transfer and wind the new web beginning onto the empty reel. In many instances, a number of attempts are necessary for this, which in turn leads to a relatively high percentage of waste.

SUMMARY OF THE INVENTION

The invention therefore creates a process for winding and an associated winding machine that do not exhibit these disadvantages.

A process is proposed that takes place in the following steps. The material web is guided by way of a movable pressing drum, which forms a winding nip with the winding roll, which is rotatably secured in a secondary transport device, wherein the line force in the winding nip is controlled/regulated during this winding phase shifting the pressing drum. In order to prepare for a reel change when a desired winding roll diameter is reached, the winding roll is moved away from the pressing drum by the secondary transport device so that the material web runs freely from the pressing drum to the winding roll. A new reel rotating at web speed is moved by a primary transport device into the free draw and is brought into a reel-changing position in which the new reel forms a new winding nip with the pressing drum. After this, the material web is cut crosswise over its width and with its new web beginning, is wound onto the new reel. During this winding phase, the control/regulation of the line force in the winding nip between the pressing drum and the new reel is in turn carried out by shifting the pressing drum. Finally, the new reel with the new winding roll is taken over by the secondary transport device, wherein the control/regulation of the line force occurs by shifting the pressing drum, even when the new reel is guided by the secondary transport device. Since the empty reel is partly wrapped by the material web before the transfer and winding-on of the new web beginning, i.e. the material web is guided over a circumference region of the new reel while the material web is still being wound onto the nearly finished winding roll, a reliable transfer of the web and start of winding of the winding roll onto the new reel can be assured. The process has a high degree of change-over reliability.

It is furthermore advantageous that the line force in the winding nip during the entire winding process is adjusted exclusively by relative movement of the pressing drum in relation to the winding roll. The pressing drum can be rapidly shifted due its relatively light weight in comparison to the weight of the growing winding roll. Consequently, jumps and fluctuations in the line force can be compensated for very rapidly. As a result of this, an exact, uniform line force in the winding nip can be adjusted/regulated during the entire, i.e., a complete winding process so that on the whole, a favorable winding quality can be achieved. Furthermore, it is particularly advantageous that a direction change of the shifting movement of the pressing drum can be carried out very rapidly due to the relatively low weight of the pressing drum in relation to the winding roll.

In a particularly preferred embodiment of the process, with the removal of the winding roll from the pressing drum, this pressing drum follows the winding roll until reaching a stop. The new reel is subsequently brought into the reel-changing position, wherein before the reel change, the new reel forces the pressing drum back from the stop. It can be assured with a relatively low control/regulation cost, that the line force during a complete winding process, i.e. from the start of winding to the final winding of the winding roll, can be exactly adjusted or maintained at a desired value by means of a shifting of the pressing drum.

Finally, an embodiment of the process is also preferable, which is distinguished by virtue of the fact that the empty reel is brought into a position disposed above a pressing drum. After this, a winding nip is formed between the pressing drum and the empty reel by relative movement between the pressing drum and the reel. The disposition of the empty reel in relation to to pressing drum is chosen so that the pressing plane, which is defined by the winding nip and the longitudinal axes of the empty reel and the pressing drum, is inclined in relation to an imaginary horizontal by an angle $\alpha$, which lies in a range of $5° \leqq \alpha \leqq 40°$, preferably $10° \leqq \alpha \leqq 35°$, in particular $15° \leqq \alpha 30°$. In this position of the empty reel, the material web is cut and its free end is wound onto the empty reel. Since the winding nip during the winding-on lies in the inclined pressing plane, the deflection resulting from the pressing force and the component of the deflection resulting from the tare weight of the reel, which component lies in the pressing plane, cancel each other out, preferably completely, but at least significantly. As a result, a line force in the winding nip can be adjusted that is uniform viewed in terms of the web width, which in turn leads to an improvement of the winding quality.

Furthermore, an exemplary embodiment of the process is preferable, which is distinguished by virtue of the fact that after the secondary transport device takes over a reel, a compensation for the diameter increase of the winding roll occurs by preferably horizontal or at least nearly horizontal shifting of the secondary transport device. The adjustment of the line force and consequently the shifting of the pressing drum occurs independently of the compensation movement of the growing winding roll. The load in the winding nip can therefore be modulated or adjusted very precisely. The fluctuations or jumps in the line force that previously occurred on an occasional basis in the winding nip are avoided at least to a large extent. By means of this, a definite, uniform winding hardness can be adjusted; in particular, an exact core winding can be assured.

In order to attain the stated object, a winding machine is also proposed. To prepare a reel change, the new reel can be shifted by the primary transport device into a reel-changing position in which a new winding nip is formed between the new reel and the pressing drum, and that in the reel-changing position, the material web is guided over a circumference region of the new reel. Since the material web that is wound on the almost finished winding roll is already wound part of the way around the new reel before the reel change, a high degree of change-over reliability can be assured.

An exemplary embodiment of the winding machine is particularly preferred in which the reel-changing position is provided above the position in which the secondary transport device takes over the new reel. In an advantageous embodiment, during the winding-on process, the new winding nip is disposed in a pressing plane that is defined by the longitudinal axes of the empty reel and the pressing drum and is inclined in relation to an imaginary horizontal by an angle a, which lies in a range of $5° \leqq \alpha \leqq 40°$, preferably $10° \leqq \alpha \leqq 35°$, in particular $15° \leqq \alpha \leqq 30°$. The component of the deflection resulting from the tare weight of the reel, which component lies in the pressing plane, and the deflection resulting from the pressing force cancel each other out, at least approximately. As a result, during the start of winding, a uniform line force in the winding nip can be assured over the entire web width so that a definite building up, first of the winding core and then of the remaining winding roll, is possible. The improvement of the winding quality in the core thus permits an exact winding of the entire winding roll.

In an advantageous embodiment of the winding machine, the diameter increase can be compensated for by a shifting of the secondary transport device and the line force in the winding nip can be adjusted, preferably regulated, by shifting of the pressing drum while the winding roll is guided by the secondary transport device. The compensation for the growing winding roll diameter and the adjustment of the line force are therefore provided by two separate devices that can be actuated or function separately from each other, the secondary transport device and the pressing drum. Due to the weight of the pressing drum, which is relatively light in comparison to the weight of the growing winding roll, the pressing drum can be rapidly shifted and consequently, jumps and fluctuations in the line force can be compensated for very rapidly. It is particularly advantageous that a direction change of the shifting movement can be carried out very rapidly by means of the pressing device due to the relatively low weight of the pressing drum. A preferably uniformly favorable winding result can be achieved by the independent shifting movements of the pressing drum and the secondary transport device.

An exemplary embodiment of the winding machine is also preferable in which the at least one pressing device, with the aid of which the pressing drum can be shifted, is embodied as a preferably hydraulic piston and cylinder unit. In a first embodiment, the maximal stroke of the piston is less than half the material layer thickness of the finished winding roll. Despite the relatively small stroke, i.e. the distance that the pressing drum can be shifted in one direction, the pressing system is not changed during the winding process. The movable pressing drum remains in practically constant contact with the winding roll except for a few seconds during the reel change. The winding machine is distinguished by means of a simple and reasonably priced design. In another, second embodiment, the provision is made that the maximal stroke of the piston is at least greater than or equal to the layer thickness of a finished winding roll.

It is possible to replace the movable secondary transport device with a secondary support which is disposed in stationary fashion and in which the reel is rotatably secured. With a stationary support, an optimal rigidity of the reel mount can be assured so that vibrations that possibly occur inside the winding machine have practically no effect on the line force/line force progression. A continuous reel tracking is therefore not necessary so that the machine design can be simplified.

Finally, another exemplary embodiment of the winding machine is preferable in which the primary and secondary transport devices are each associated with only one individual drive, preferably a central drive, with the aid of which a torque can be exerted on the reel. The drive associated with the primary transport device is preferably also used to accelerate an empty reel to the travel speed of the material web.

BRIEF DESCRIPTION OF THE DRAWINGS

The invention will be explained in more detail below in conjunction with the drawings.

DETAILED DESCRIPTION OF EXEMPLARY EMBODIMENTS

Figure 1:
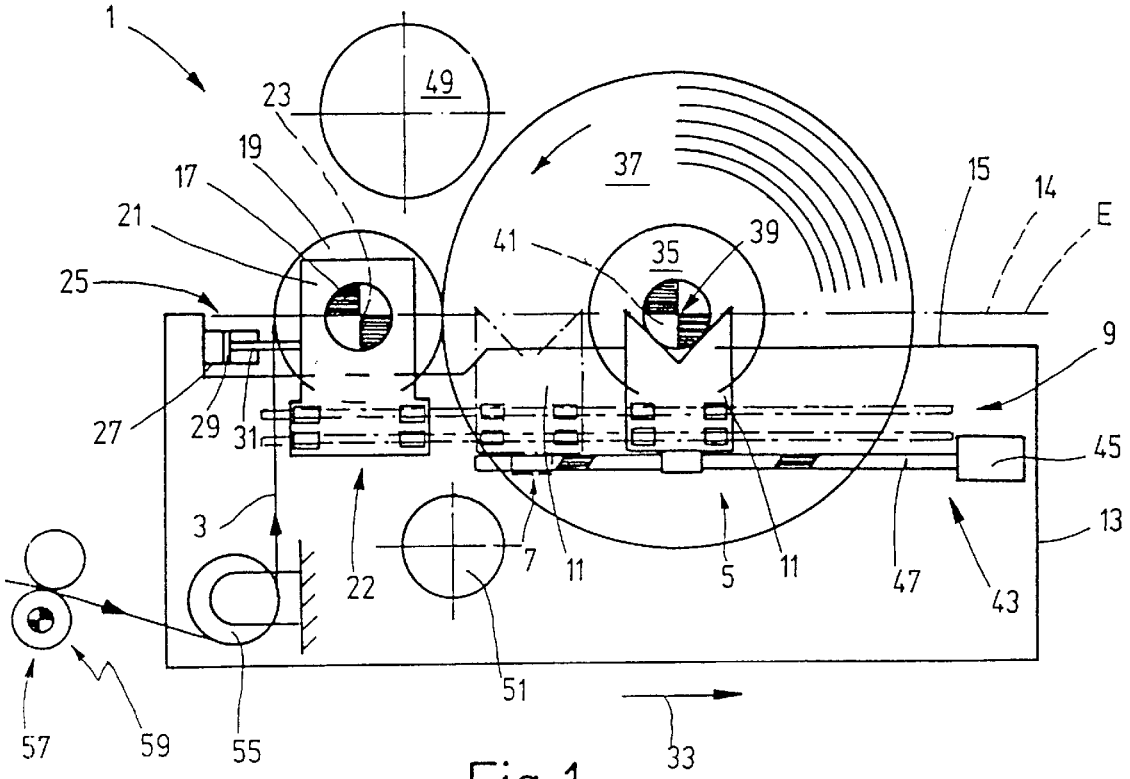
FIGS. 1 to 4 each show a schematic diagram of an exemplary embodiment of the winding machine according to the invention, in different winding phases.

The winding machine described below can be generally employed for the winding of a material web. The winding machine can be disposed at the end of a machine for manufacturing or upgrading a material web, for example a paper web, in order to wind the finished material web into a winding roll. The winding machine can, however, also be used to re-roll finished winding rolls. Purely by way of example, it is assumed that, in this instance, it concerns a winding machine for the winding of a continuous paper web.

FIGS. 1 to 4 each show a schematic representation of a first exemplary embodiment of a winding machine 1 for winging a paper web (referred to below as the material web 3), onto a reel, winding core, or the like. A sequence of operational steps of the winding machine 1 emerges from the FIGS. 1 to 4. The winding machine 1 in this exemplary embodiment includes two secondary transport devices 5 and 7, which each include a secondary block 11 that can travel on second rails 9. The rails 9 are disposed parallel to an imaginary plane and are fastened to a machine frame 13. The secondary transport devices 5, 7 rotatably secure and guide a reel along a second, horizontally extending guide track 14, which lies in an imaginary plane E, depicted with dashed lines. This plane spans an area that is disposed perpendicular on the plane of the drawing of FIG. 1. Furthermore, guide rails 15 are attached to the machine frame 13, which are disposed parallel to an imaginary horizontal plane. A reel exhibiting bearing pins can be stored on the guide rails 15 and is carried by them, i.e. the weight of the reel and the weight of the winding roll wound onto the reel are supported by the guide rails 15. In an alternative embodiment of the winding machine 1, not shown in FIGS. 1 to 4, only a single secondary transport device is provided, which simplifies the design of the winding machine.

The winding machine 1 furthermore comprises a pressing drum 19, which can be driven by a central drive 17 and is rotatably secured on a guide block 21, which can be moved on first rails 22. In this exemplary embodiment, the rails 9 and 22 are disposed parallel to one another. The distance between the guide rails 15 and the longitudinal axis 23 of the pressing drum 19, which lies in the plane E, is therefore constant. The guide block 21 is associated with a pressing device 25 that is embodied here as a hydraulic piston and cylinder unit, which is fastened to the machine frame 13. The pressing device 25 includes a piston 29 that is guided in a cylinder 27 and is connected to a piston rod 31 that engages the guide block 21. When the piston rod 31 travels outward, the guide block 21 and consequently, the pressing drum 19, (which is also called a Pope drum), are shifted toward the right in FIG. 1, (i.e. the direction of an arrow 33). When the piston rod 31 travels into the cylinder 27, the messing drum 19 moves toward the left in FIG. 1. The maximal stroke of the piston 29, i.e. how far the piston rod 31 can travel out of or into the cylinder 27, is preferably less than half the material layer thickness S of a finished winding roll. In another exemplary embodiment, the stroke of the piston 29 is greater than or equal to the material layer thickness S of a finished winding roll. In another advantageous embodiment, the pressing device includes two hydraulic piston and cylinder units in order to shift the pressing drum 19 and to generate a desired line force.

As is apparent from FIG. 1, the pressing drum 19 forms a winding nip with a winding roll 37 that has been wound onto a reel 35, i.e. the pressing drum 19 forms a nip together with the winding roll 37. The pressing drum 19 thus touches the circumference of the winding roll 37 over its entire length. The reel 35, which is rotatably secured and guided by the secondary transport device 5 in this winding phase, is engaged by a secondary drive 39, which in this embodiment is a central drive. With the aid of the secondary drive 39, torque can be exerted on the reel 35 that is resting on the guide rails 15 and is secured by the secondary transport device 5.

Figure 9:
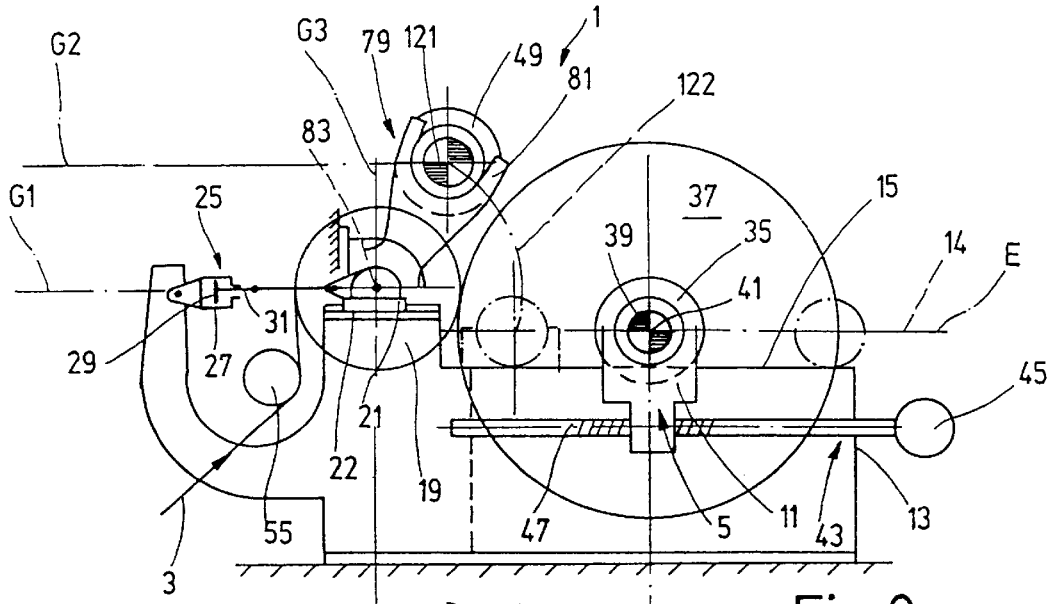
FIGS. 9 to 11 each show a schematic representation of a third exemplary embodiment of the present invention.
Figure 12:
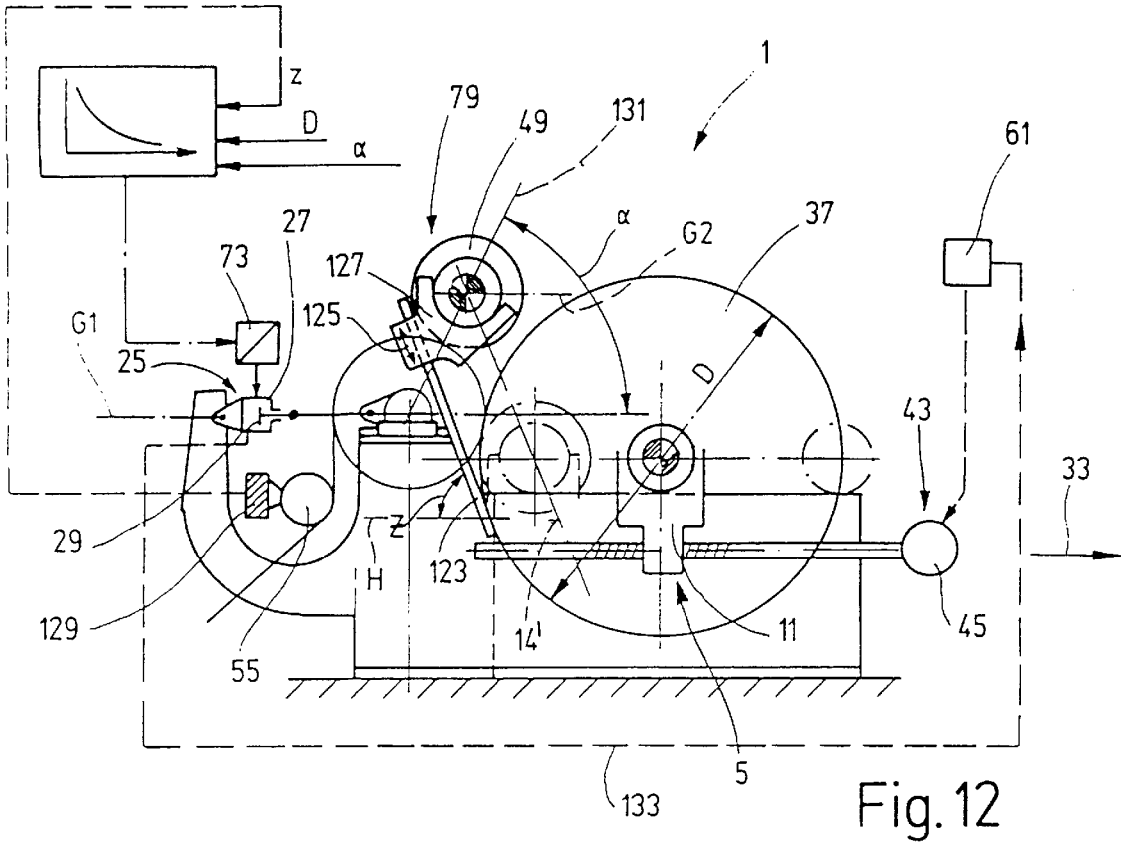
FIGS. 12 to 13 each show a schematic representation of other exemplary embodiments of the present invention and FIGS. 14*a* to 14*e* each show a very schematic representation of a sixth exemplary embodiment of the present invention.
Figure 13:
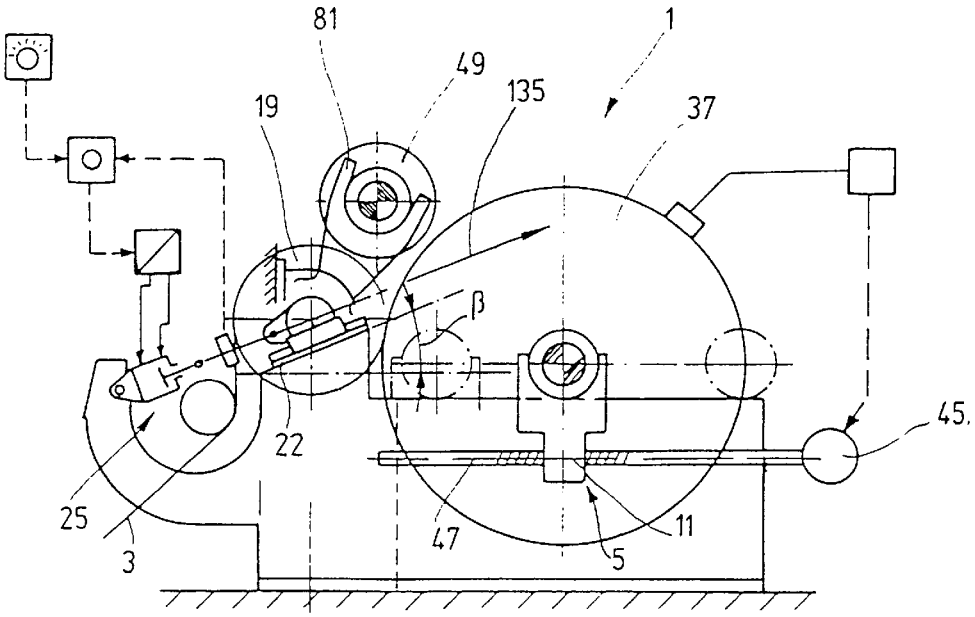

The guide rails 15 are attached to the machine frame 13 in such a way that the longitudinal axis 41 of the reel 35, which rests via its bearing pins on the guide rails 15, lies in the same plane E as the longitudinal axis 23 of the pressing drum 19. In another advantageous exemplary embodiment of the winding machine 1, the pressing drum 19 and the reel resting on the guide rails 15 are disposed at different heights (FIGS. 9, 12, 13).

The material web 3 is guided by way of the pressing drum 19 and is wound onto the winding roll 37. The line force in the winding nip is controlled by the pressing device 25 associated with the pressing drum 19, i.e. the pressing drum 19 is pressed against the circumference of the winding roll 37, such that a desired winding hardness of the winding roll or a uniform winding hardness progression can be adjusted. In another exemplary embodiment, the line force in the winding nip is regulated, i.e. the pressing device 25 is part of a regulating circuit that automatically maintains or adjusts the line force to a desired value. Fluctuations in the line force can be reliably compensated for (or avoided) by shifting the pressing drum 19 by the pressing device 25 so that a desired winding hardness can be continuously produced. The line force can be maintained at a desired value (e.g., a constant value even if there is a malfunction in the winding process. A malfunction can, for example, be a not-entirely-precise movement of the secondary transport device so that the position of the winding nip formed by the pressing drum 19 and the winding roll 37 shifts slightly, or can be a balance error in the pressing drum and/or the winding roll.

The growing diameter of the winding roll 37 is compensated for by shifting the winding roll 37 to the right in the direction of the arrow 33. To this end, the secondary transport device 5 is moved toward the right, which brings about a slaving of the reel 35 and consequently of the winding roll 37. For the moving of the secondary transport devices 5 and 7, a stroke device 43 is provided here, which includes a threaded spindle 47 driven by a motor 45.

Figure 2:
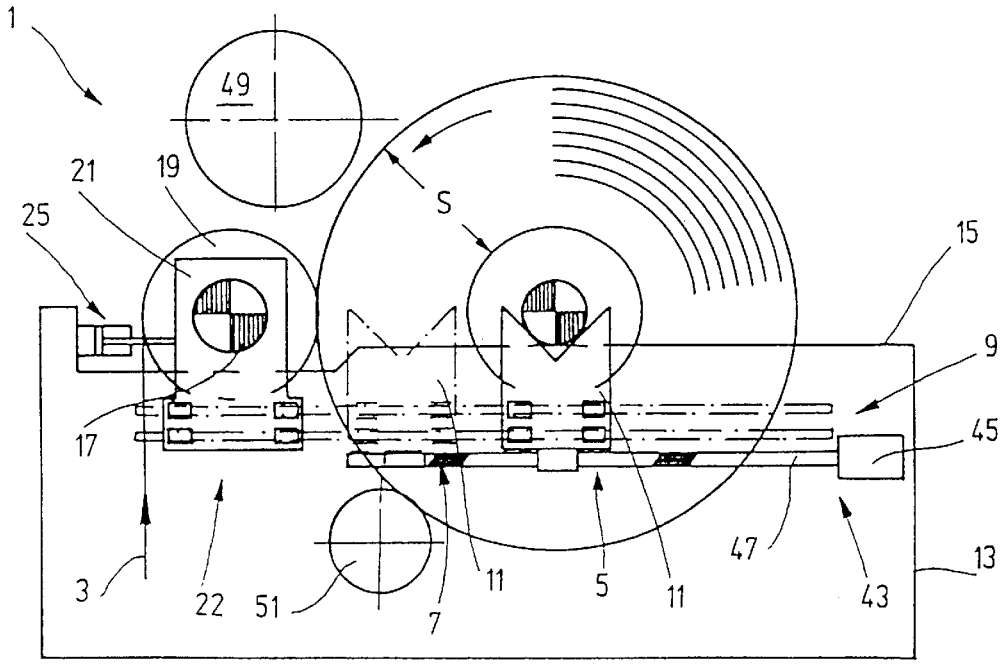
Figure 3:
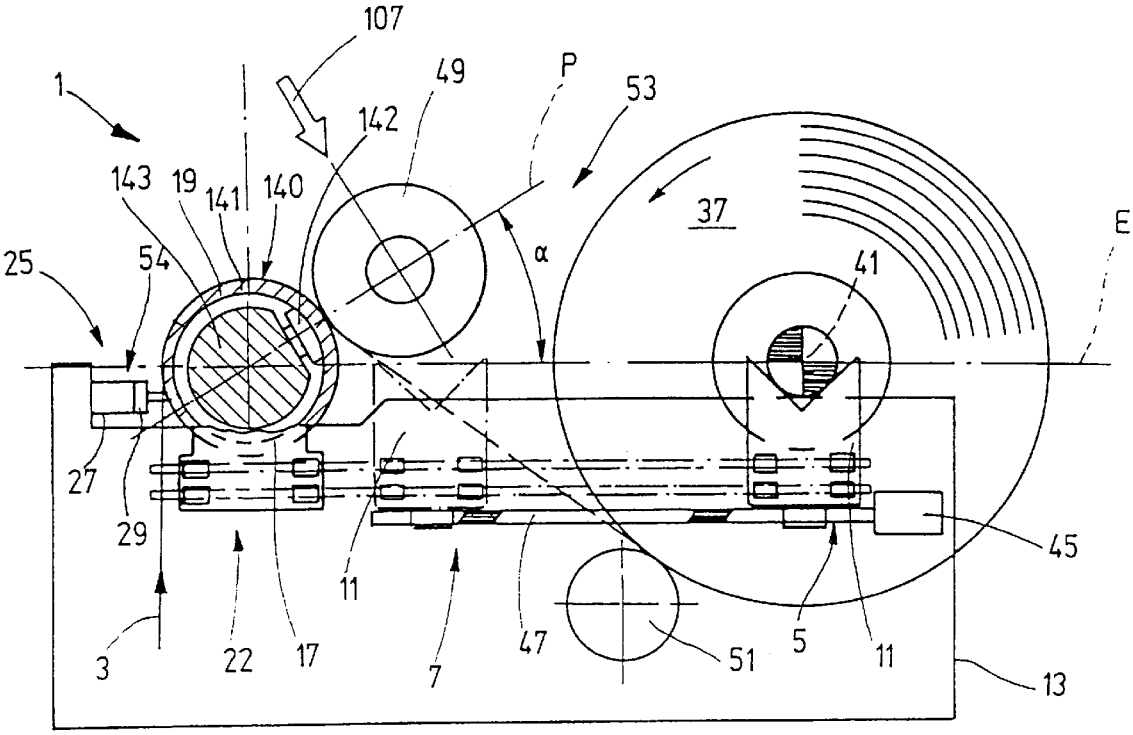
Figure 4:
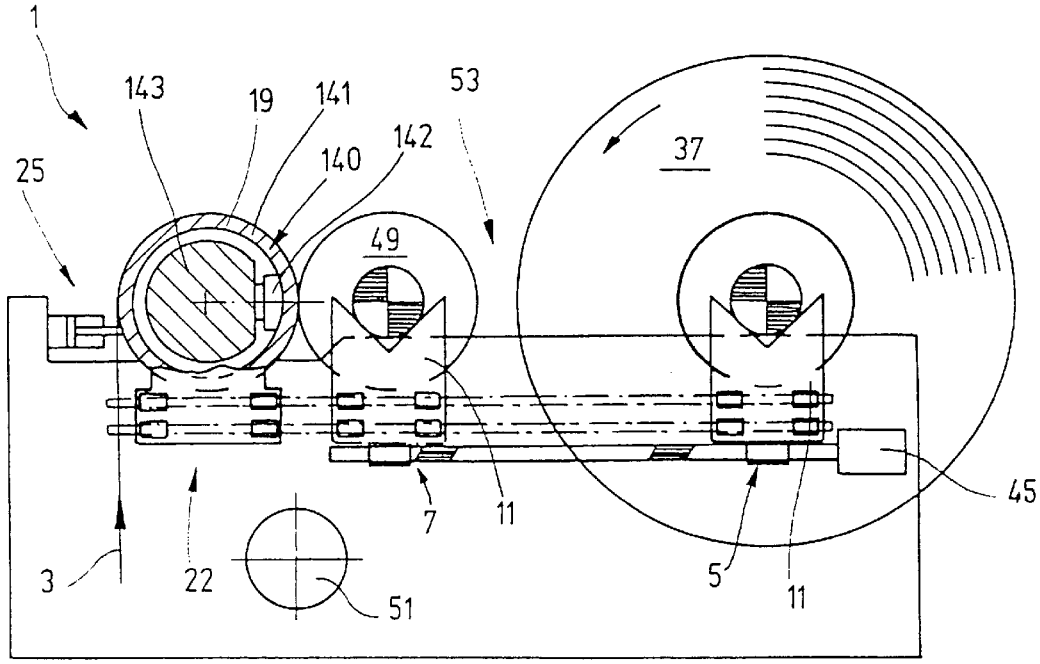
Figure 14A:
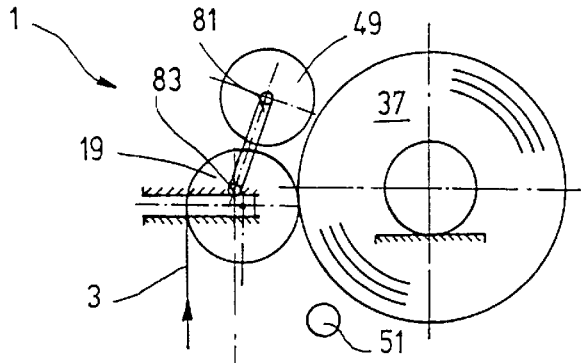
Figure 14B:
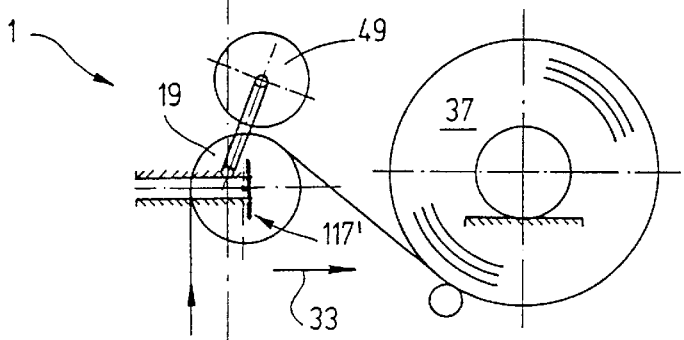
Figure 14C:
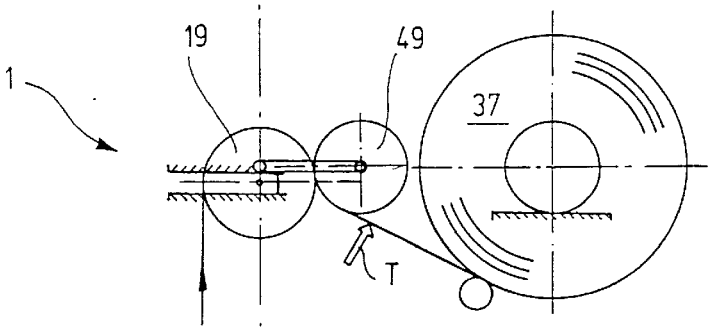
Figure 14D:
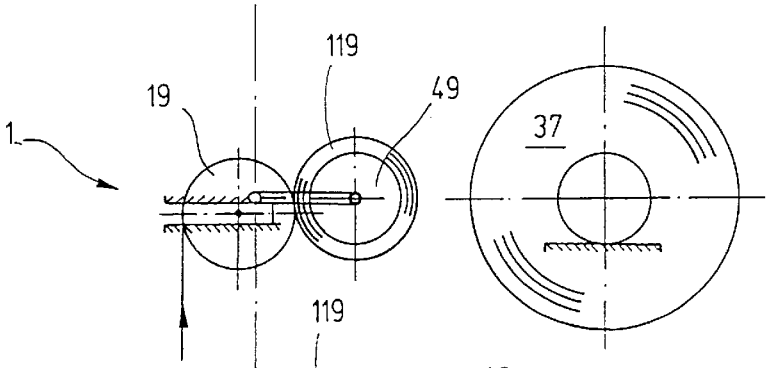
Figure 14E:
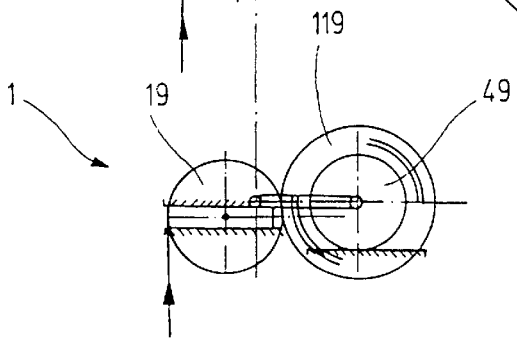

An empty reel 49, which is secured by a primary transport device, not shown, is disposed in a ready position above the pressing drum 19 (FIGS. 1 and 2). For the preparation of a reel change, the reel 49 is shifted with the aid of the primary transport device from the ready position into a reel-changing position in which this reel is secured in a stationary and rotatable fashion by the primary transport device, whose design is described in more detail below (FIG. 3). While the empty reel 49 is disposed in the reel-changing position, a winding nip is formed by means of a relative movement between the pressing drum 19 and the empty reel 49, i.e. the pressing drum and the empty reel touch each other on their circumference over their entire length. After the cutting of the material web by means of an intrinsically known cutting device, not shown, (symbolically depicted in FIGS. 8*c* and 14*c* by means of an arrow T), the web is wound with its new web beginning onto the empty reel 49, which is disposed in the reel-changing position. By means of the primary transport device, the reel 49 can be moved along a first guide track from the ready position into the reel-changing position and from this into a finished winding position (FIG. 4). In connection with the present invention, the "finished winding position" is understood to mean a position of the reel 49 in which it rests with its bearing pins on the guide rails 15. The first guide track can have a curved, preferably arc-shaped and/or linear course. The primary transport device is associated with a central drive, not shown, which is also called the primary drive and is for the reel or winding roll held by this transport device, by means of which the reel can be acted on with a driving and/or a braking moment.

In FIG. 3, the empty reel 49 is disposed in the reel-changing position in which after a cutting procedure, the new web beginning is wound onto the reel 49. The reel 49 forms a winding nip with the pressing drum 19 and this nip lies in a pressing plane P, which is inclined in relation to an imaginary horizontal by an angle $\alpha$, which lies in a range of $5° \leqq \alpha \leqq 40°$, preferably $10° \leqq \alpha \leqq 35°$, in particular $15° \leqq \alpha \leqq 30°$. In this instance, purely by way of example, the angle $\alpha$ amounts to approximately 32°. Angles $\alpha$ that lie in the range from 15° to 30° have turned out to be particularly advantageous. Since the winding nip lies in the inclined pressing plane P, the deflection resulting from the pressing force and the component of the deflection resulting from the tare weight, which component lies in the pressing plane P, cancel each other out, so that a uniform line force can be adjusted in the winding nip over the width of the web 3. A favorable winding quality thus can be achieved.

Beneath the pressing drum 19, a pressing element is provided, which in this exemplary embodiment is constituted by a press roll 51 that extends over the entire width of the winding roll 37 and is also called a squeeze roll. By means of a guide device (not shown), the drive roll 51 can be pressed against the circumference of the winding roll 37. The press roll 51 serves to prevent air from slipping in between the winding layers of the winding roll, for example when the material web 3 travels in a free draw from the pressing drum 19 to the winding roll 37. The press roll 51 can be acted on with a torque and accelerated to web speed by a drive, for example a central drive. In an alternative, the pressing element is a stationary pressing brush, which is affixed to at least one bar extending over the entire width of the winding roll. By shifting the bar, the pressing brush is placed against the winding roll, such that air that has slipped between the winding layers is virtually stroked out. In comparison to the press roll, the pressing brush has a simplified and therefore more reasonably priced design since it does not rotate and consequently, an additional drive is not required. This is also true for a so-called air brush, which is an air blower nozzle that extends over the width of the web and acts on the winding roll in a contact-free manner.

In the following, the function of the winding machine 1 will be explained in more detail in conjunction with a winding process: The material web 3 is guided by way of the pressing drum 19 and wound onto the winding roll 37 that is guided by the secondary transport device 5 (FIG. 1). Before the winding roll 37 reaches its final diameter, the press roll 51 is pressed against the circumference of the winding roll 37 (FIG. 2). The material web 3 is consequently guided both through the winding nip between the pressing drum 19 and the winding roll 37, and through the winding nip between the press roll 51 and the winding roll 37. For the transfer of the continuously supplied material web 3 onto the empty reel 49, the winding roll 37 is moved by the secondary transport device 5 along the guide rails 15 in the direction of the arrow 33, the distance increases between the longitudinal axis 23 of the pressing drum 19 and the longitudinal axis 41 of the winding roll 37, which in this instance both lie in the plane E. An intermediary space 53 is formed between the pressing drum 19 and the winding roll 37 (FIG. 3). In the region of the intermediary space 53, the material web 3 is transferred in a free draw from the pressing drum 19 onto the winding roll 37. While the secondary transport device 5 is moved along with the winding roll 37, the press roll 51 is guided after the winding roll 37 in such a way that the line force in the winding nip between the press roll 51 and the winding roll 37 maintains a desired value until the pressing drum 19 comes into contact with at least one "stop" 54. In this exemplary embodiment, the stop 54 is produced by virtue of the fact that the piston 29 of the pressing device 25 strikes against the inner wall of the cylinder 27, i.e. reaches its extended position, in which the piston 29 rests against the inner wall of the cylinder 27. The pressing drum 19 thus has a fixed position.

Then from above, the empty reel 49, which is disposed in the ready position and has been accelerated to the travel speed of the material web 3, is shifted downward along the first guide track and brought into the reel-changing position in the intermediary space 53 between the pressing drum 19 and the winding roll 37 (FIG. 3). The pressing drum 19 that has been moved against the stop 54 is disposed in the first guide track so that when the empty reel 49 is moved into the reel-changing position, this reel is brought into contact with the pressing drum 19. As a result, the reel 49 forces the pressing drum 19 away from the stop 54 opposite the direction of the arrow 33, which finishes the formation of the nip/winding. A cutting device (not shown) disposed, for example, in the region of the intermediary space 53, cuts the material web 3 crosswise over its width. The new web beginning (i.e., the leading edge of the web) is wound onto the reel 49. The reel 49 remains in the reel-changing position for a variable duration of time, for example until the winding of the core of the new winding roll is finished. Then, the reel 49 is guided along the first guide track from the reel-changing position into the finished winding position and is lowered directly onto the guide rails 15 (FIG. 4). The reel 49 is taken over, i.e. is guided and held, by the second secondary transport device 7, which is disposed in the take-over position. In the winding phase shown in FIG. 4, a few layers of the material web 3 (not shown) are already wound onto the reel 49 that is still being driven by the primary drive or by a central drive associated with the secondary transport device 7.

After the finished winding roll 37 has been braked, for example with the aid of the secondary drive 39 and/or the press roll, it can be removed from the secondary transport device 5, while the press roll 51 is shifted back into its position shown in FIG. 1. As long as the secondary drive 39 is associated with both secondary transport devices 5 and 7, after the braking of the full winding roll, now the secondary drive is effectively connected to the reel 49, and the primary drive and the primary transport device are released from the reel 49. The growing diameter of the winding roll that is wound onto the reel 49 and is not shown in FIG. 4 is compensated for by a shifting of the secondary transport device 7 along the guide rails in the direction of the arrow 33. The line force in the winding nip between the pressing drum 19 and the winding roll wound onto the reel 49 is maintained at a desired value during the entire winding process by shifting of the pressing drum 19 by the pressing device 25.

A web guide roll 55 is shown in FIG. 1, which is disposed below the pressing drum 19 and is rotatably attached to the machine frame 13. A unit 57, which is disposed before the web guide roll 55 in terms of the travel direction of the material web and which in this instance, purely by way of example, is a pressing device 59, the material web 3 is guided to the web guide roll 55, deflected by this roll, and conveyed further to the pressing drum 19. The material web 3 is wound around the web guide roll 55, preferably in a circumference range from 155° to 205 °. The winding angle is preferably at least 150°, even when the pressing drum 19 is being shifted during the winding process. It is hereby assured that the line force in the winding nip is not influenced by a change of the web longitudinal stress in the region between the unit 57 and the pressing drum 19. The pressing device 59 comprises two press rolls that form a nip, at least one of which is driven, as shown in FIG. 1.

In order to uncouple the winding process to a large extent from the fluctuations of the production process of the material web, the material web guidance is preferably embodied so that the material web 3 is wound around the pressing drum 19 by approximately 180°. Since the material web 3 is guided over a relatively large circumference region of the pressing drum 19, fluctuations in the draw have practically no influence on the pressure of the pressing drum 19 against the winding roll 37 and consequently have practically no influence on the line force. Furthermore, small movements of the pressing drum 19 are compensated for so that they cause no draw fluctuations; the pressing drum 19 is therefore reactionless. As a result of the relatively large winding angle, a further assurance can be made that a slightly inclined position of the pressing drum 19 does not lead to an undesirable wrinkle formation. It is furthermore possible to connect only stationary guide rolls and spreader rolls before the pressing drum, which do not have to be guided after the movable pressing drum, such that the design of the winding machine can be simplified.

The above-mentioned process can be readily inferred from the description of FIGS. 1 to 4. This process provides for the fact that the material web is guided by way of a preferably horizontally movable pressing drum 19, which forms a winding nip with the winding roll 37 that is rotatably secured in a secondary transport device, wherein the line force in the winding nip is controlled or regulated by shifting of the pressing drum. In order to prepare for a reel change when a desired winding roll diameter is reached, the winding roll 37 is moved away from the pressing drum by the secondary transport device so that the material web 3 travels freely from the pressing drum 19 to the winding roll 37; a free draw is thus produced. A primary transport device brings a new reel, 49 i.e. an empty one, which is rotating at web speed, into a reel-changing position in which the new reel 49 forms a winding nip with the pressing drum 19. Then, the material web 3 is cut crosswise over its width and the new web beginning is wound onto the new reel 49. In this winding phase, the control/regulation of the line force in the winding nip between the pressing drum 19 and the new reel 49 or the winding roll wound onto it is in turn carried out by shifting the pressing drum 19. Finally, the secondary transport device takes over the new reel 49 with the new winding roll, wherein the control/regulation of the line force continues to be carried out by shifting the pressing drum 19.

The formation of a winding nip between the pressing drum 19 and the empty reel can be realized by virtue of the fact that the empty reel is moved along the first guide track and strikes against the pressing drum 19. In another embodiment, the winding nip is formed by shifting the pressing drum 19 with the aid of the pressing device 25 in the direction of the reel disposed in the reel-changing position. Naturally, both the reel 49 and the pressing drum 19 can be moved toward each other in order to form a winding nip. Independent of how the winding nip is formed, abrupt fluctuations in the line force of the kind that occur, for example, at the moment the reel is transferred from the primary transport device to the secondary transport device, can be compensated for or prevented with the aid of the movable pressing drum 19. The line force can thus be continuously maintained exactly at a desired value.

As is shown in FIGS. 3 and 4, the pressing drum 19 can be a deflection adjusting roll 140 whose roll jacket 141 is supported on a stationary yoke 143 by a series of support elements 142, which produces a bulging outer contour of the pressing drum 19. Only one of the support elements 142 that act in the direction toward the winding gap can be seen in the view of FIGS. 3 and 4. The design of the deflection adjusting roll 140 is known (e.g. DE-OS25 55 677) so that this is not described in detail herein. The support elements 142 can preferably be controlled individually, i.e. independently of one another, whereby a desired bulging of the roll jacket 41 can be adjusted. The yoke 143 can be rotated around a fixed axis, in this instance, the longitudinal axis 23. The support elements 142 that cooperate with the yoke 143 are pivoted in such a way during a rotation of the yoke 143 that the direction in which they act follows the wandering motion of the winding nip.

Through the adjustment of a desired bulging of the outer contour of the pressing drum 19, the material web 3, guided by way of it can, viewed crosswise to the travel direction of the web, be definitely stretched, preferably before the material web travels into the winding nip. This prevents wrinkling of the winding layers wound onto the winding roll; and consequently, the winding result can be improved. In terms of the longitudinal direction of the drum, the deflection of the pressing drum 19 can preferably be adjusted in sections, as described above. As a result, the desired spreading of the material web 3 can be influenced, preferably adjusted, by varying the outer contour of the pressing drum 19. In an advantageous exemplary embodiment, the pressing drum 19 is part of an active vibration damping system, i.e. the pressing drum 19 is oscillatory. In connection with the current invention, the term "oscillatory" is understood to mean that the pressing drum can execute a rapid shifting motion towards and away from the winding roll. The pressing device 25, i.e. the hydraulic piston and cylinder unit represented in FIGS. 1 to 4, can therefore very rapidly execute a direction change in the shifting motion of the pressing drum 19.

Figure 5:
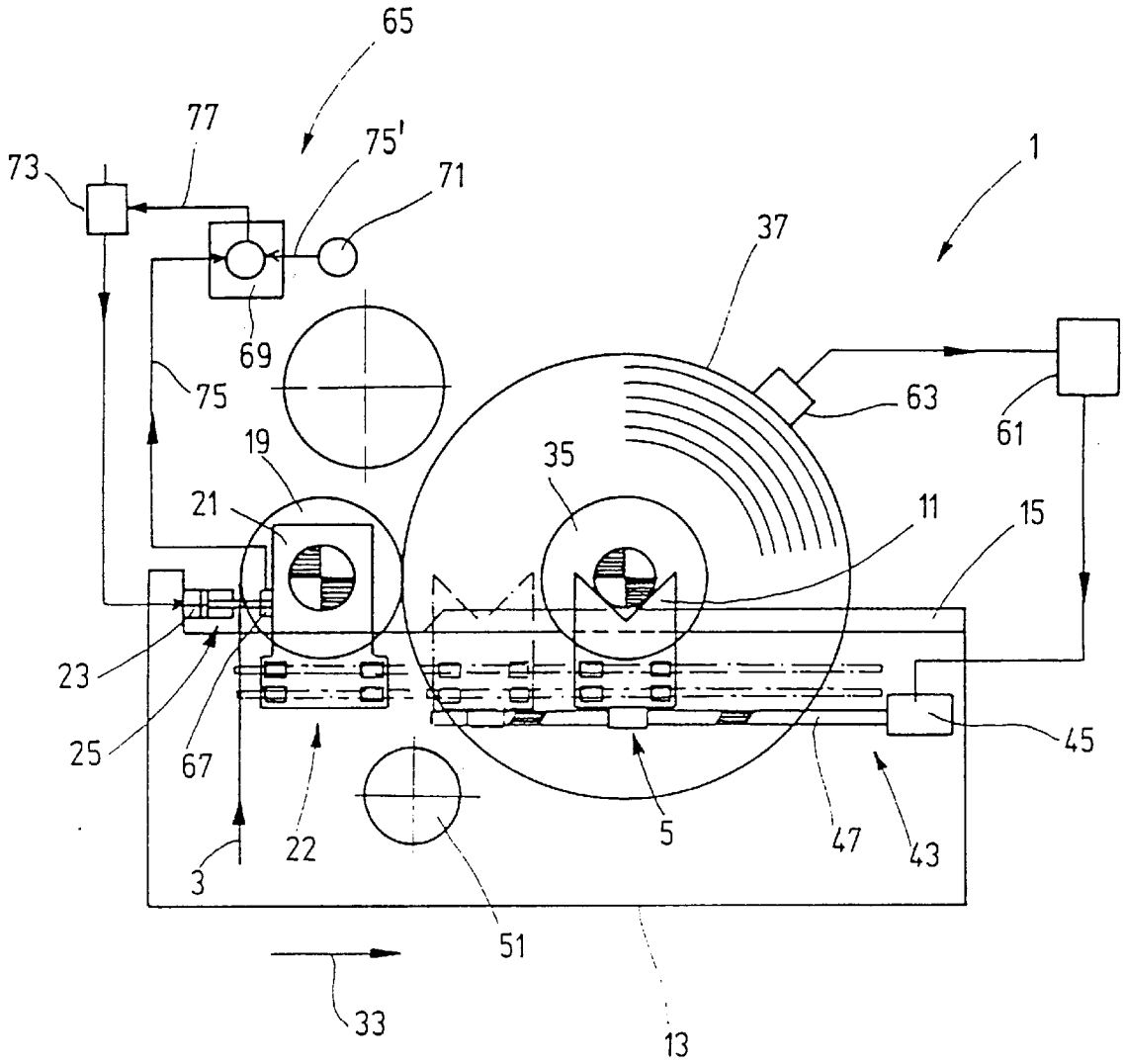
FIG. 5 shows a schematic diagram of the winding machine according to FIGS. 1 to 4, with an embodiment of a control for the line force in the winding nip.

FIG. 5 shows a schematic representation of the winding machine according to FIGS. 1 to 4 with control elements. Parts that coincide with those in FIGS. 1 to 4 are provided with the same reference numerals so that in this regard, reference will be made to the descriptions of FIGS. 1 to 4. For the control of the winding machine 1, a control unit 61 is provided, which controls the motor 45 of the threaded spindle as a function of the speed of the increase in diameter of the winding roll 37. The diameter increase of the winding roll 37 is measured by a measuring device 63. The position of the secondary transport device 5 thus changes solely, i.e., exclusively, in accordance with the increase of the winding roll 37. The magnitude of the line force in the winding nip formed between the diameter of pressing drum 19 and the winding roll 37 is solely, i.e., exclusively, determined by moving of the guide block 21 holding the pressing drum 19, preferably regulated by a regulating device 65. This includes a measuring device 67 for the line force, a regulator 69, a set point transmitter 71, and a control unit 73. The measuring device 67 is connected by way of a measurement line 75 to the regulator 69 or feeds into this. The set point transmitter 71 is connected by way of a line 75' to the regulator 69 and indicates the desired set point to the regulator 69. The regulator 69 is in turn connected by way of a line 77 to the control unit 73.

In the event that the value of the line force, which is measured by the measuring device 67 diverges from the set point predetermined by the set point transmitter 71, the regulator 69 sends a signal to the control unit 73 by way of the line 77. This control unit 73 then changes the pressure in the cylinder 27 of the pressing device 25 in such a way that the measured value of the line force approaches the set point. The line force can thus be kept at desired value such as constant value even in the event of a malfunction in the winding process. A malfunction can, for example, be a not-entirely-precise movement of the secondary transport device 5 so that the position of the winding nip formed by the pressing drum 19 and the winding roll 37 guided by the secondary transport device 5 shifts slightly.

In a preferred exemplary embodiment, the provision is made that in order to control the line force, the pressing drum 19 can be shifted independently of the travel speed of the secondary transport device. Furthermore, it is possible that the stroke device 43 that cooperates with the secondary transport device, i.e. the motor 45 that drives the threaded spindle 47, can be controlled in such a way that the position of the winding nip formed between the pressing drum 19 and the winding roll 37 is essentially constant while the winding roll 37 is resting on the guide rails 15. The "constant position" of the winding nip is understood to mean its position inside the winding machine 1, i.e. the winding roll 37 is shifted in the direction of the arrow 33 by the secondary transport device 5 with a speed such that only the diameter increase of the winding roll 37 is compensated for.

In another exemplary embodiment, the stroke device 43 associated with the secondary transport device 5, 7 can be controlled such that the position of the winding nip formed between the pressing drum 19 and the winding roll 37 shifts with an increasing winding roll diameter during the winding process, for example in a range from 50 mm to 200 mm.

Figure 6:
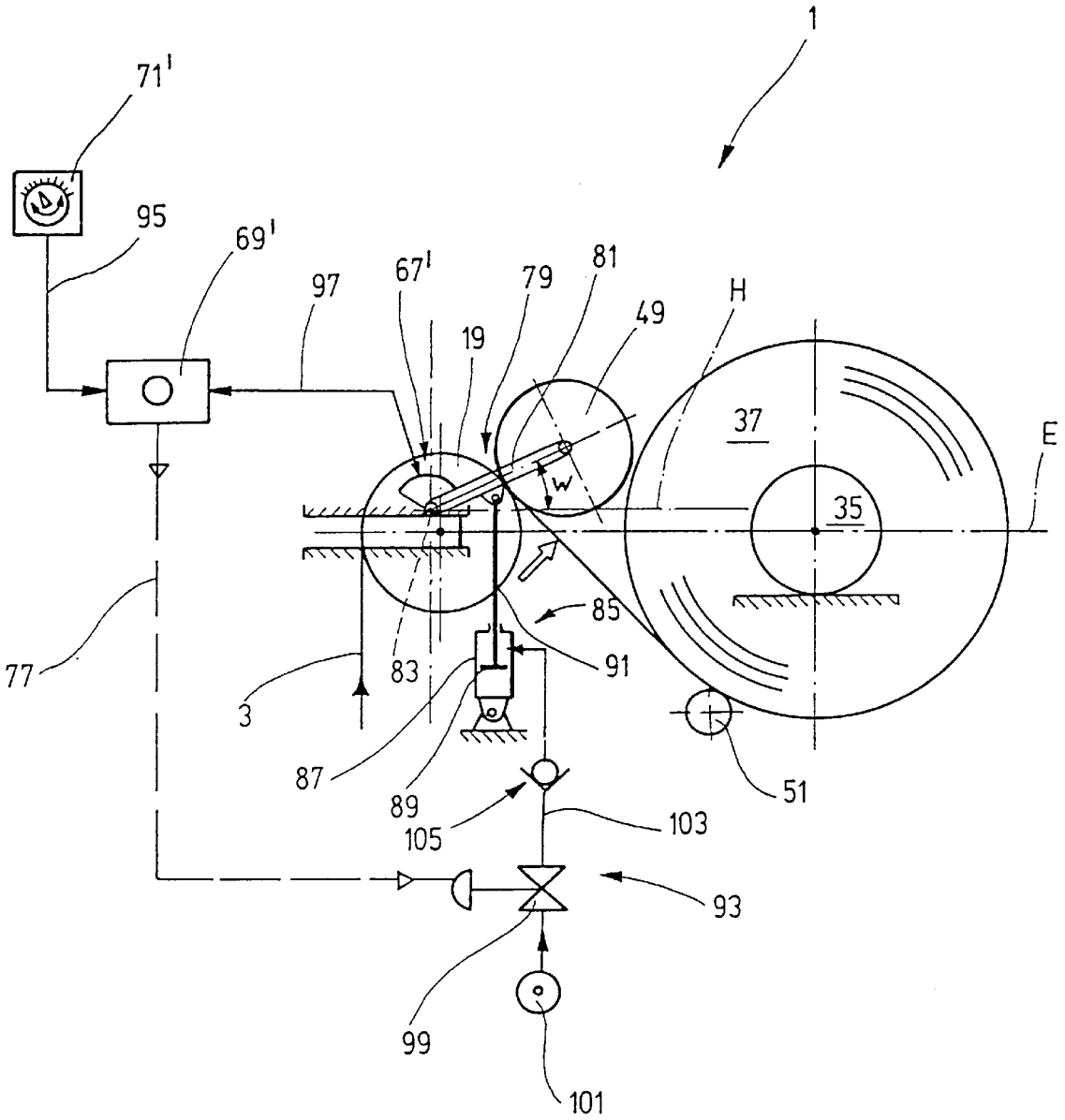
FIG. 6 shows a schematic diagram of another exemplary embodiment of the winding machine, with a regulating device for adjusting the reel-changing position.

FIG. 6 shows a schematic representation of another exemplary embodiment of the winding machine 1. Parts that coincide with those in FIGS. 1 to 5 are provided with the same reference numerals so that in this regard, reference will be made to the descriptions of FIGS. 1 to 5. A part of an exemplary embodiment of the primary transport device 79 is shown in FIG. 6. This includes two primary pivoting levers 81, only one of which is depicted in this view. The primary pivoting levers 81 to which the new reel 49 is rotatably secured can be pivoted around an axle 83 that runs parallel to the longitudinal axis of the reel 49. The primary pivoting levers 81 are disposed in a stationary manner inside the winding machine 1; i.e., the axle 83 has a fixed, unchangeable position in the machine frame 13, at least during a complete winding operation. The primary pivoting levers 81 are associated with a stroke device 85, which is assigned, for example, to the machine frame 13, and this stroke device includes at least one piston and cylinder unit (preferably hydraulic) associated with a primary pivoting lever. The piston and cylinder unit includes a piston 89 that is guided in a cylinder 87 and is connected to a piston rod 91 that engages at least one of the primary pivoting levers 81. When the piston rod 91 travels outward out of the cylinder 87, the primary pivoting levers 81 are pivoted counterclockwise around the axle 83, and counter clockwise when the piston rod 91 travels inward. Naturally, the stroke device 85 can also include, for example, two piston and cylinder units, which are each associated with a primary pivoting lever 81.

In this winding phase, the primary pivoting levers 81, which hold the empty reel 49 in the reel-changing position, as shown in FIG. 6, are inclined in relation to an imaginary horizontal H, represented with a dashed line, by an angle w, which in this instance is approximately 26°. The angle w can be adjusted by the stroke device 85. In order to adjust the angle w, a regulating device 93 is provided, which includes a regulator 69', a set point transmitter 71', and a measuring device 67' for determining the position of the primary drive levers 81. The set point transmitter 71' is connected to the regulator 69' by way of a signal line 95 and the measuring device 67' is connected to the regulator 69' by way of a signal line 97. In order to change the angle w and consequently to change the location of the reel-changing position, a new set point is input into the set point transmitter 71'. A variance comparison is executed with the aid of the regulator 69'. In the event of a deviation, the regulator 69' sends a signal by way of a line 79 to a hydraulic regulating valve 99, which then opens up the through flow between a pump 101 and a medium line 103 leading from the regulating valve 99 to the cylinder 87. The medium supplied by the pump 101 for example a hydraulic fluid or a gas, can alternatively be introduced into one of the partial chambers of the cylinder 87 that are divided from each other by the piston 89. If the medium is introduced into the upper partial chamber in the depiction according to FIG. 6, as indicated with an arrow, then the piston rod 91 travels into the cylinder 87, which reduces the angle w. If medium flows into the lower partial chamber of the cylinder 87, the piston rod 91 travels out of the cylinder, which increases the angle w. After the desired angle w has been set, the regulating valve 99 interrupts the connection between the pump 101 and the line 103. A check valve 105 is provided in order to prevent a return flow of the medium from the cylinder 87 in the direction of the regulating valve 99.

With the aid of the regulating device 93, a definite angle w can be set at any time during the winding operation. Moreover, it is particularly advantageous that the location of the reel-changing position can be predetermined before the next reel change, wherein for example if needed, an angle w can also be adjusted that is equal to zero (for example according to FIG. 14*c*).

Figure 7:
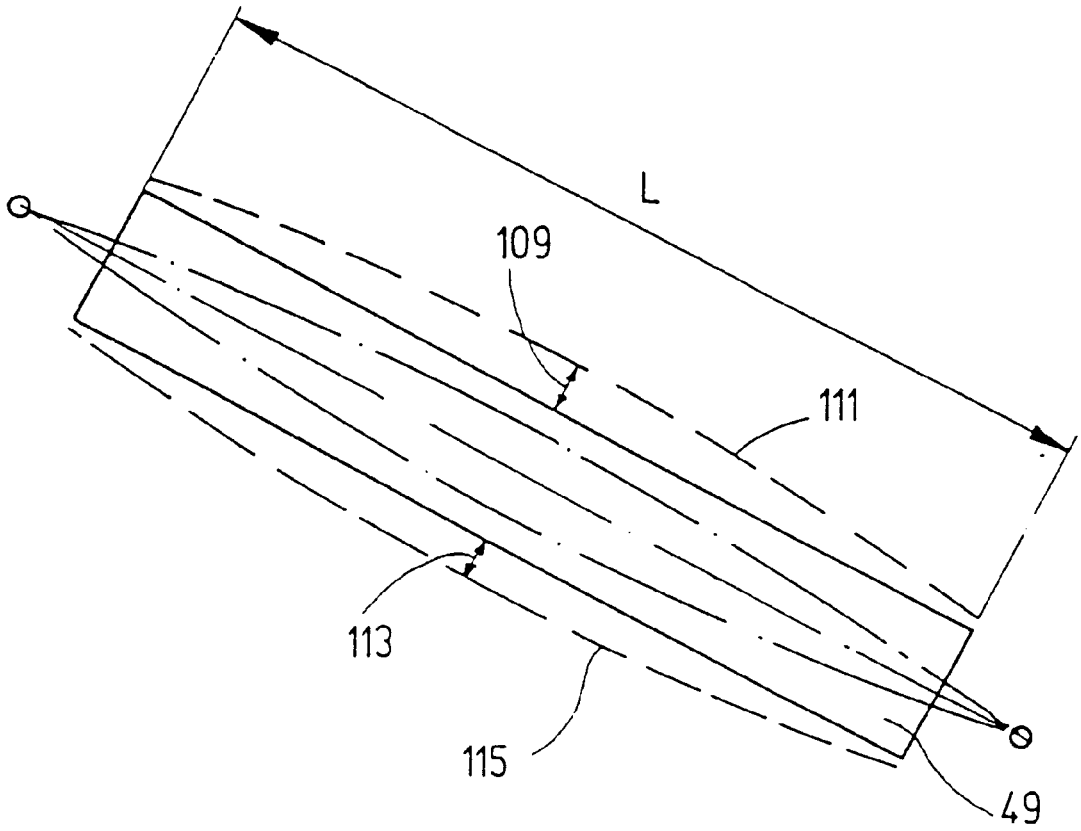
FIG. 7 shows a schematic diagram of a reel shown in FIG. 3, in a reel-changing position.

FIG. 7 shows a view of the reel 49 in the winding phase shown in FIG. 3, in which the reel 49 is disposed in the reel-changing position and forms a winding nip with the pressing drum 19. The viewing direction of the reel 49 is indicated in FIG. 3 with an arrow 107. In this exemplary embodiment, the force with which the pressing drum 19 is pressed against the circumference of the reel 49 leads to a deflection of the reel 49 that is represented with a double arrow 109. The curvature of the outer contour of the reel 49 that is caused by the deflection is schematically represented with a dashed line 111. The component of the deflection, which results from the tare weight of the reel 49, located in the pressing plane P, is represented with a double arrow 113. The curved outer contour of the unsupported reel is schematically represented with a line 115.

As is apparent from FIG. 7, the deflections act in opposite directions, wherein they are at least basically equal in magnitude. The deflections therefore cancel each other out, preferably completely, but at least substantially so that a uniform line force in the winding nip can be adjusted over the entire width of the material web.

FIGS. 8*a* to 8*e* each show a schematic representation of a part of the winding machine 1 described in conjunction with the preceding Figures, in different winding phases. The reel-changing procedure already described briefly above will be explained in more detail below in conjunction with FIGS. 8*a* to 8*e*.

Figure 8A:
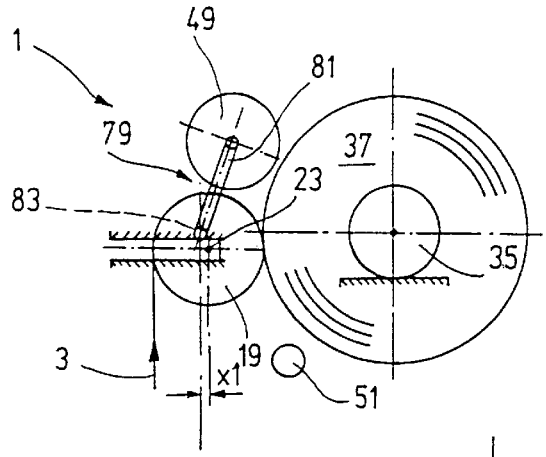
FIGS. 8*a* to 8*e* each show a schematic representation of the winding machine according to FIGS. 1 to 5, in different winding phases.

Before the reel change, an empty reel 49 is taken over by the stationary winding station, namely by the primary transport device 79, which in this instance includes primary pivoting levers 81 (FIG. 8*a*). To this end, the primary pivoting levers 81 are pivoted counter-clockwise upward into the empty reel take-over position shown in FIG. 8*a*. The empty reel 49 is accelerated by the primary drive to the travel speed of the material web 3. The pressing element, in this instance the press roll 51, is pressed against the circumference of the almost full winding roll 37. The winding roll 37, which is secured by the secondary transport device, is driven by the secondary drive, and moved together with the press roll 51 away from the pressing drum 19 in the direction of the arrow 33. The pressing drum 19 is guided after the winding roll 37 in order to maintain a desired line force in the winding nip until the pressing drum 19 runs up against a stop 117, whereby its shifting motion is stopped. The winding roll 37 travels farther in the direction of the arrow 33, whereby a free draw between the pressing drum and the winding roll is formed.

Since the pressing drum 19 comes into contact with a stop 117 before a reel change, the pressing drum 19 has a fixed, definite position before each reel change. If the distance between the pressing drum and the full winding roll 37 has reached at least a minimal value, the new reel 49 is moved into the reel-changing position in which the reel rests against the circumference of the pressing drum 19 (FIG. 8*c*). The forming of the nip/winding nip occurs automatically since the pressing drum 19 resting against the stop 117 is disposed in the movement path of the empty reel 49 at this time. The nip is considered to be closed when the pressing drum has been forced by the empty reel 49 so far back from the stop 117 in the opposite direction from the arrow 33 that the pressing drum 19 exerts the desired pressing force against the empty reel 49, for example by means of the regulating device 65 (FIG. 5).

Figure 8B:
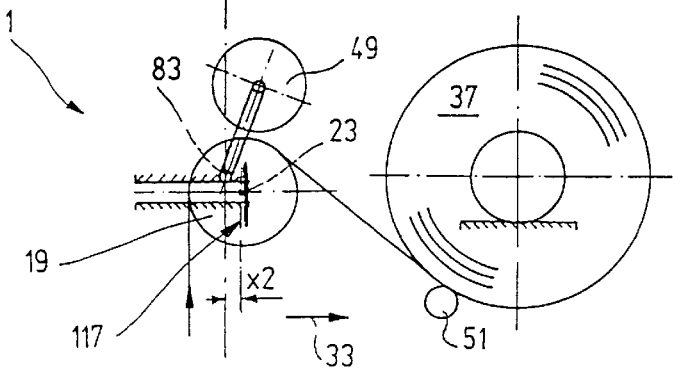
Figure 8C:
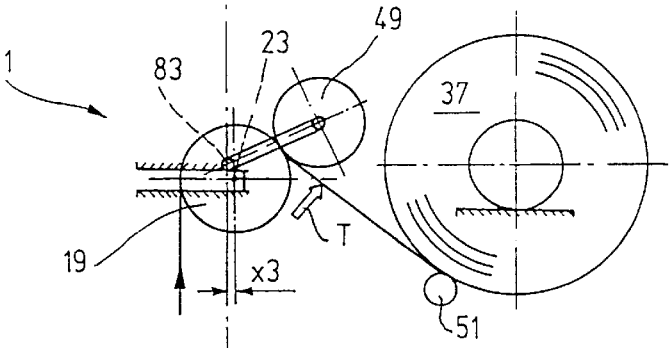

For clarity, in FIGS. 8*a* to 8*c,* the distance x of the longitudinal axis 23 of the pressing drum 19 from the stationary axle 83 of the primary pivoting levers 81, which is disposed on an imaginary vertical V, is shown immediately before the reel change (FIG. 8*a*), during the reel change (FIG. 8*b*), and after the reel change (FIG. 8*c*). In the winding phase according to FIG. 8*b,* in which the pressing drum 19 has already come into contact with the stop 117, the distance x2 exists, which is greater than the distance x3, which is set after the pressing drum 19, is forced back by means of the reel 49, which has been shifted into the reel-changing position. It is furthermore apparent that before the pressing drum 19 comes into contact with the stop 117, it has a distance x1 to the axle 83, which is less than the distance x2.

After the formation of the winding nip, the material web 3 is cut in the region of the free draw and the new web beginning is guided onto the reel 49. It is particularly advantageous that the empty reel 49 disposed in the reel-changing position is already wound around by the material web over a small circumference region before the cutting, which facilitates the change-over process considerably so that a high degree of reliability can be assured in the reel change. After the reel change, the reel 49 is preferably held in the reel-changing position until the winding core of the new winding roll 119 wound onto the reel 49 is formed, for example until the winding roll 119 exhibits a layer thickness S of 20 mm to 100 mm.

During the core winding, i.e. when the reel 49 is rotatably secured on the primary pivoting levers 81, the pressing drum 19 moves away from the longitudinal axis of the reel 49 in accordance with the diameter increase of the winding roll 119. In terms of distance, the shift of the pressing drum 19 corresponds exactly to the horizontal component of the radius increase. During the winding-on of the new winding roll 119, the full winding roll 37 is braked and removed from the variable winding station, i.e., by the secondary transport device.

In a preferred exemplary embodiment in which only one secondary transport device is provided, the secondary transport device is shifted to the left in the direction of the pressing drum in order to take over reel 49 stored on the guide rails 15. In the exemplary embodiment of the winding machine, in which two secondary transport devices are provided, they are used alternatingly for the guidance of a new winding roll. The two secondary transport devices therefore only respectively guide every other winding roll. While the reel 49 with the new winding roll wound on it is being guided by the secondary transport device, the radius increase of the winding roll is compensated for by corresponding shift of the reel 49 with the aid of the secondary transport device. In terms of amount, the shifting of the reel 49 in the horizontal direction corresponds exactly to the radius increase.

Figure 8D:
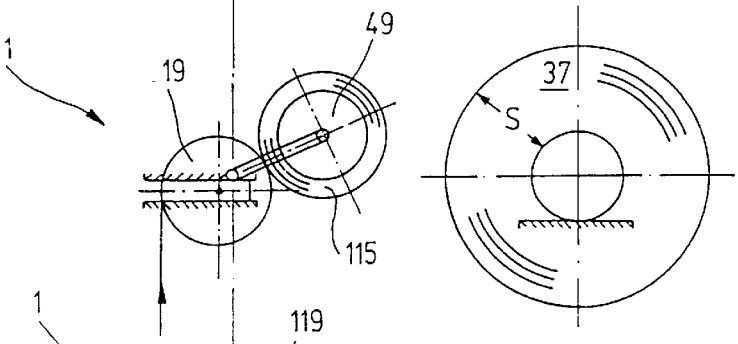
Figure 8E:
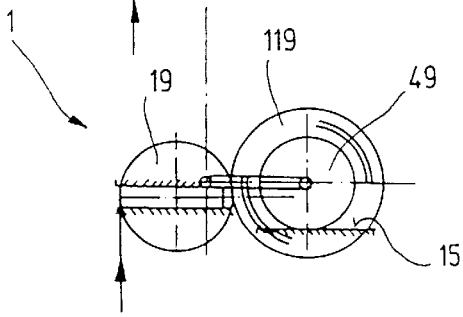

In another embodiment of the process that can be carried out using the winding machine described in conjunction with FIGS. 8*a* to 8*e,* the provision is made that the winding roll 37 guided by the secondary transport device is continuously moved without an intermediate stop from the position shown in FIG. 8*a* into the position shown in FIG. 8*d*. At the same time, the primary pivoting levers 81 and the new reel 49 move from the position shown in FIG. 8*b* to the position shown in FIG. 8*e,* preferably also without an intermediate stop. The reel change takes place when the new reel 49 being moved by the primary pivoting levers passes through the position shown in FIG. 8*c*. The speed of movement of the winding roll 37, which is guided by the secondary transport device, and the reel 49, which can be moved with the aid of the primary pivoting levers 81, can be constant or can change at (preferably) at least one arbitrary point. The movement course of the primary pivoting levers 81 securing the new reel 49 can be simply controlled by means of a time-dependent change of the set point for the angle w, which set point is supplied by the set point transmitter 71' (FIG. 6).

Figure 10:
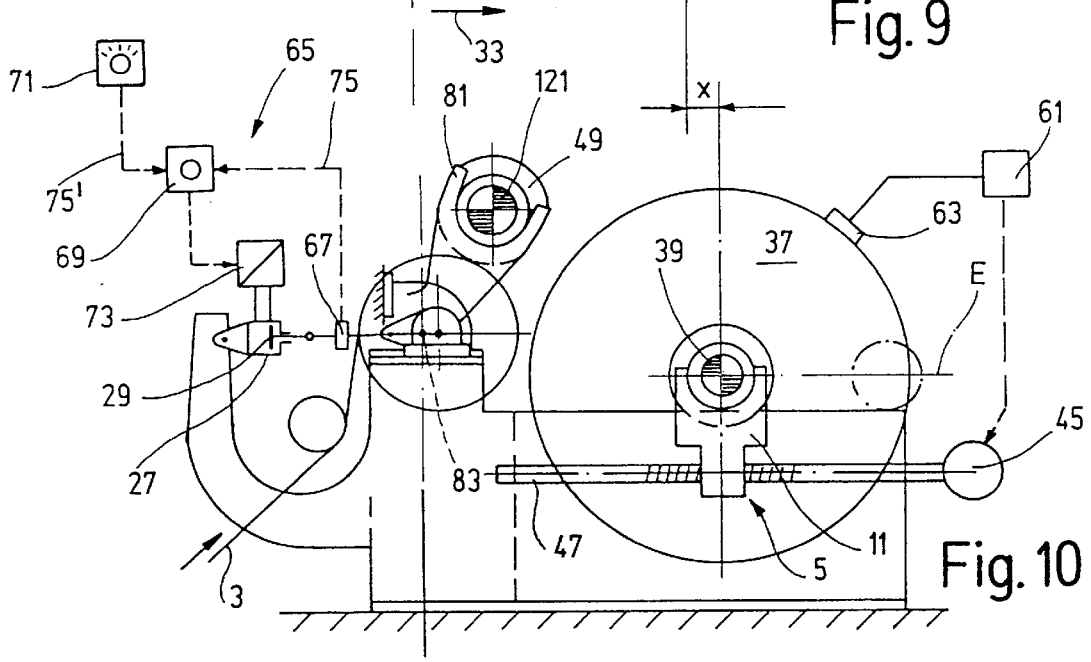
Figure 11:
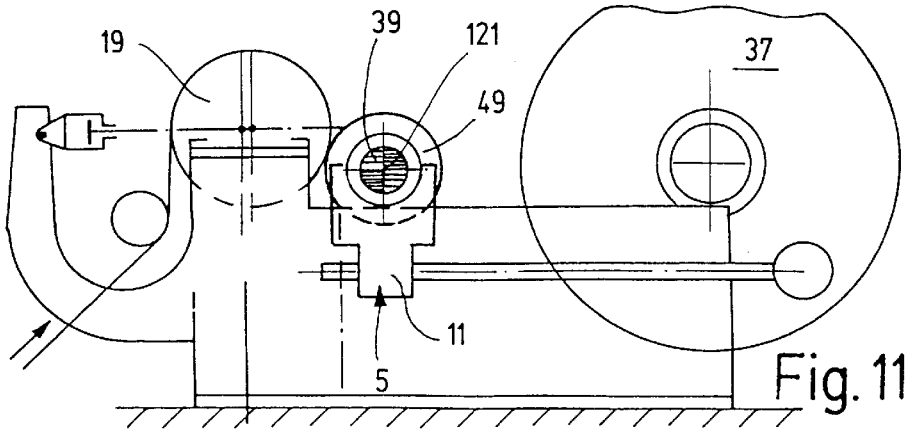

FIGS. 9 to 11 each show a side view of a part of another exemplary embodiment of the winding machine 1, in different winding phases. The design of the winding machine 1 corresponds essentially to the winding machine described in conjunction with FIGS. 1 to 8. The differences will be addressed in more detail below. Parts that are the same are provided with the same reference numerals so that in this regard, reference will be made to the descriptions of the preceding figures.

First, the function of the winding machine 1 should be explained in more detail below in conjunction with a winding operation. The material web 3 is guided by way of the pressing drum 19 and is wound onto the winding roll 37, which is guided by the secondary transport device 5 and is driven by the secondary drive 39 (FIG. 9). Before the winding roll 37 reaches its final/desired diameter above the pressing drum 19, the empty reel 49 is rotatably attached to the primary pivoting levers 81, i.e. the movement of the empty reel 49 is limited to a rotation around its longitudinal axis, and is moved into the reel-changing position.

It is apparent from FIG. 9 that the reel 49 disposed in the reel-changing position is spaced apart from the pressing drum 19 in such a way that no winding nip is formed yet. In the reel-changing position, the center point of the empty reel 49 is disposed on an imaginary second straight line G2, which is represented with dashed lines and is disposed essentially parallel to an imaginary first straight line GI and is disposed on a higher level in relation to it. As is apparent from FIG. 9, the center point of the pressing drum 19 is disposed on the straight line G1 extending parallel to the guide rails 15. In a reel change, before the transfer of the material web 3, the empty reel 49 is accelerated by the primary drive 121 associated with the primary pivoting levers 81 and is brought to the travel speed of the material web 3. In order to transfer the continuous material web 3 onto the empty reel 49, the travel speed of the secondary transport device 5 guiding the winding roll 37 is increased by corresponding control of the motor 45 driving the threaded spindle 47. The pressing drum 19 remains in constant contact with the winding roll 37, i.e. when the winding roll 37 is shifted along the linear second guide track 14, the pressing drum 19 is guided after it so that the line force in the winding nip is maintained at a desired value.

As is apparent from FIG. 9, the distance between the straight lines G1 and G2 is less than the sum of the radii of the pressing drum 19 and the reel 49. As a result, in a shift toward the right in FIG. 9, the pressing drum 19 comes into contact with the reel 49 that is disposed in the reel-changing position. This corresponds to the winding phase shown in FIG. 10. At the moment in which a winding nip is formed between the pressing drum 19 and the empty reel 49, or at least shortly after this, the reel change is triggered. In the reel change, the material web 3 is cut a cutting device (not shown), and the new web beginning is wound onto the reel 49. At the moment of the reel change, i.e. just before the cutting and transfer of the material web 3 onto the empty reel, an intermediary space is already formed between winding roll 37 and the pressing drum 19.

It must be stressed that the pressing drum 19 does not assume any fixed position before a reel change, i.e. does not come into contact with a stop, as in the exemplary embodiment described in conjunction with FIGS. 1 to 8, but comes directly into contact with the empty reel 49, which is held in a fixed position (reel-changing position) by the primary pivoting levers 81.

As shown in FIG. 10, the piston 27 of the pressing drum 25 is spaced apart from the inner wall of the cylinder 29 at this moment; the piston 27 is therefore not disposed in a full extended position.

After the new web beginning is wound onto the reel 49, this reel is transported along the first guide track 122, which is arc-shaped here, into the finished winding position by a pivoting of the primary pivoting levers 81 clockwise around the axle 83. During the pivoting procedure, the reel 49 is rotatably secured and supported by the primary pivoting levers 81. The reel 49 is continuously driven by the primary drive 121, i.e. is likewise moved along the first guide track 122.

In FIG. 11, the new reel 49 is shown in its finished winding position, i.e. it rests with its bearing pins on the guide rails 15 which support the weight of the reel 49 and the winding roll that is wound on it, not shown, which only has a few winding layers. During the transfer of the reel 49 from the reel-changing position (FIGS. 9 and 10) into the finished winding position (FIG. 11), the pressing drum 19 is moved along the straight line G1 pressing device 25 so that the line force in the winding nip is maintained at a desired value during the entire transfer.

In FIG. 11, the winding roll 37 is disposed in a removal position in which the winding roll can be lifted from the guide rails 15 by known devices and removed from the winding machine 1. In the exemplary embodiment of the winding machine 1 shown in FIGS. 9 to 11, only a single secondary transport device and only one secondary drive 39 are provided. In FIG. 11, they are already shifted toward the left in the direction of the pressing drum 19 in order for the secondary transport device 5 to take over the reel 49. In this connection, the secondary transport device 5 and the secondary drive 39 can be shifted into the take-over position jointly or independently of each other. While the secondary transport device 5 is taking over the reel 49 from the primary pivoting levers 81, the secondary drive 39 is coupled to the reel 49 so that temporarily, both drives 39 and 121 are coupled to the reel 49. After this, the primary drive 121 is uncoupled from the reel 49 and moved counterclockwise back along the first guide track into the reel-changing position. The diameter increase of the winding roll is wound on the reel 49 guided by the secondary transport device 5, is now compensated for by a shift of the secondary transport device 5, and consequently the reel 49 toward the right in the direction of the arrow 33. The line force in the winding nip between pressing drum 19 and the winding roll wound on the reel 49 is controlled by shifting the pressing drum 19, as described above.

For the sake of clarity, only one control of the winding machine 1 is shown in FIG. 10, which includes a regulating device 65. The design and the operation of the regulating device 45 is the same as described above with respect to FIG. 5.

In a preferred exemplary embodiment, the pressing drum 19 can be moved independent of the travel speed of the secondary transport device 5, in order to control the line force. It is furthermore possible that the stroke device 43 associated with the secondary transport device 5, i.e. the motor 45 driving the threaded spindle 47 can be controlled such that the position of the winding nip formed between the pressing drum 19 and the winding roll 37 is essentially constant. The "constant position" of the winding nip is understood to mean its position inside the winding machine 1. The winding roll 37 is thus shifted in the direction of the arrow 33 by means of the secondary transport device 5 with a speed that compensates for only the diameter increase of the winding roll 37.

In another exemplary embodiment, the stroke device 43 associated with the secondary transport device 5 can be controlled such that the position of the winding nip formed between the pressing drum 19 and the winding roll 37 shifts with the increasing winding roll diameter during the winding process, for example in a range from 50 mm to 200 mm.

In a preferred exemplary embodiment, during the winding-on of an empty reel 49, the winding nip is always at the same location, i.e. its position inside the winding machine during a reel change is constant or at least basically constant. As a result, during the winding-on of an empty reel 49, there are always equivalent angular ratios, for example of the pressing forces acting on the reel 49, so that the deflection of the empty reel can be calculated and correspondingly compensated for in order to adjust a desired line force progression in the winding nip. Naturally, in this exemplary embodiment it is also possible, with a regulating device 93 that is described for example in conjunction with FIG. 6, to shift the reel-changing position in which the winding nip is formed.

FIG. 12 schematically represents a side view of another exemplary embodiment of the winding machine 1. Parts that coincide with those described in conjunction with FIGS. 1 to 11 are provided with the same reference numerals so that in this regard, reference will be made to the descriptions of FIGS. 1 to 11. In this exemplary embodiment, the primary transport device 79 includes a securing device 127 that can be moved on third rails 123 in the direction of a double arrow 125 and the empty reel 49 is held in a stationary and rotatable fashion in this securing device 127. The securing device 127 thus permits a rotary motion of the reel 49 and hinders it from a translatory motion. By moving the securing device 127, the reel 49 can be moved from the reel-changing position (not shown), along the straight first guide track 14' realized by the rails 123, into the finished winding position in which the reel 49 rests on the guide rails 15. In addition, the reel 49 is moved or lowered from a higher level (G2) to a lower level (G1). The third rails 123 are inclined in relation to an imaginary horizontal H represented with a dashed line by an angle z, which in the exemplary embodiment shown in FIG. 12, lies in a range from 45° to 90°. Due to the inclination of the rails 123, the travel path of the reel 49 from the reel-changing position downward into the finished winding position is similar to the travel path of a reel that is pivoted by means of primary pivoting levers around an axle 83 that is fixed in relation to the machine frame (FIG. 9).

Based on FIG. 12, a second embodiment of a control/regulation for adjusting the line force in the winding nip between the pressing drum and a reel or a winding roll can be inferred, which differs from the control/regulation described in conjunction with FIG. 10 by virtue of the fact that the travel speed of the secondary transport device 5 is adjusted or changed as a function of the position of the piston 29 in the cylinder 27 of the pressing device 25. The regulator 73 can control/regulate the pressure in the cylinder 27 and consequently the line force in the winding nip as a function of a number of parameters. The parameters are the longitudinal stress of the material web 3 (draw) measured with a measuring device 129, the diameter D of the winding roll 37, and an angle α, which indicates the position of a reel guided by the primary transport device 79. The diameter D of the winding roll 37 and the angle α are inferred from a calculated and/or determined control curve, which is shown by way of example in FIG. 12.

The angle α is measured between the straight line G1 and a plane 131 which intersects the longitudinal axes of the pressing drum 19 and the empty reel 49.

The position of the piston 29 in the cylinder 27 is sent to the control unit 61 by way of a signal line 133 and this unit controls the motor 45 of the stroke device 43, which motor drives the threaded spindle 47.

FIG. 13 shows another exemplary embodiment of the winding machine 1 according to the invention, with a control that is described in conjunction with FIGS. 5 and 10. Parts that are the same are provided with the same reference numerals so that in this regard, reference will be made to the descriptions of the preceding Figs. In this exemplary embodiment, the rails 22, upon which the guide block 21 which rotatably secures the pressing drum 19 can be moved, are inclined in relation to an imaginary horizontal by an angle β, which in this instance lies between 0° and 45°. In a shift by the pressing device 25 in the direction of an arrow 135, the pressing drum 19 is raised from a lower-lying level to a higher-situated level, i.e. is moved obliquely upward. As is apparent from FIG. 13, the pressing drum 19 is only in contact with the winding roll 37, but is not in contact with the empty reel 49 disposed in the reel-changing position.

Also in the exemplary embodiment shown in FIG. 13, the weight of the pressing drum 19 is still for the most part supported by the rails 22 so that a sufficiently precise control of the line force in the winding nip is readily possible. Only a small portion of the weight of the pressing drum influences the measurement precision and/or adjustment precision of the line force, namely only the slope descent component.

In another exemplary embodiment not shown in the figures the linear guidance, which is for the pressing drum 19 and is provided by the rails 22 and the guide block 21, can be pivoted, for example with the aid of at least one pivoting lever.

FIGS. 14*a* to 14*e* each show a schematic representation of a part of the winding machine 1 that has been described in conjunction with the preceding FIGS. 1 to 11 and 13, in various winding phases. Only the differences in operation are addressed in detail below. In the exemplary embodiment represented in FIGS. 14*a* to 14*e*, before a reel change, the new reel 49 is stored on the guide rails 15, not shown. In order to prepare for a reel change, the pressing drum 19 is moved into contact with a stop 117' which is positioned so that when the new reel 49 is brought into the reel change position, the pressing drum 19 is forced back by the new roll 49, while the reel 49 approaches the guide rails 15. The winding-on of the new reel 49 is thus carried out only after the reel is set down onto the rails, such that fluctuations and/or jumps in the line force progression that can occur when setting the reel down onto the guide rails during the winding-on operation are reliably prevented. Furthermore, the mechanical engineering costs of the winding machine described in conjunction with FIGS. 14*a* to 14*e* can be simplified in relation to the other exemplary embodiments since for example, a stable lateral shaft for connecting the primary pivoting levers can be eliminated.

Also in the exemplary embodiment of the winding machine described in conjunction with FIGS. 14*a* to 14*e*, the winding roll 37 can be continuously moved along the second guide track, i.e. without an intermediate stop. While the winding roll 37 in the FIGS. 14*a* to 14*d* is guided toward the right, at the same time, the new reel 49 is lowered, preferably continuously, from the position shown in FIG. 14*b* into the position shown in FIG. 14*c*. The speed of the movement of the winding roll 37 and the new reel 49 in the winding phases shown in FIGS. 14*a* to 14*e* can be constant or can change at at least one arbitrary point.

The above-mentioned process can be readily inferred from the description of FIGS. 1 to 14. The material web 3 is guided by a pressing drum 19 that can be moved horizontally or at least essentially horizontally, which forms a winding nip with the winding roll 37 that is rotatably secured in a secondary transport device. During this winding phase, the line force in the winding nip is controlled/regulated by shifting of the pressing drum 19. When a desired winding roll diameter is reached, in order to prepare for a reel change, the winding roll 37 is moved away from the pressing drum 19 with the aid of the secondary transport device so that the material web 3 travels freely from the pressing drum 19 to the winding roll 37. A new reel 49, rotating at the web travel speed, is brought into a reel-changing position by means of a primary transport device and forms a new winding nip with the pressing drum 19. Then, the material web is cut crosswise over its width and the new web beginning is wound onto the new reel 49. During this winding phase as well, the control/regulation of the line force in the winding nip between the pressing drum 19 and the new reel 49 is in turn realized by shifting of the pressing drum 19. Finally, the secondary transport device takes over the new reel 49 with the new winding roll. In this winding phase as well, i.e. when the new reel 49 is being guided by the secondary transport device, the control/regulation of the line force in the winding nip is exclusively realized by shifting the pressing drum 19. A desirable winding result can be achieved by virtue of the fact that the line force is adjusted by shifting the pressing drum 19 during the entire winding operation. A high degree of reliability during a reel change can be assured with the above-described process since the new reel 49, which is moved into the reel-changing position in the free draw, is wound around at least part of the way by the material web 3 before the reel change takes place.

From all of this, it becomes clear that in the above-described exemplary embodiments of the winding machine in which the primary drive can only be moved along the first guide track, whose design can therefore be simplified by virtue of the fact that the primary drive is mounted in a stationary fashion to a part of the primary transport device, which can be moved together with the reel along the first guide track. In another embodiment of the winding machine, the provision is made that the primary drive can be moved both along the first guide track and also part of the way along the second guide track. Moreover, it is naturally also possible that the secondary drive can be disposed in a stationary fashion on the secondary transport device, which further simplifies the design of the winding machine.

In a alternative embodiment the stroke of the pressing drum 19, i.e. the maximal distance that the pressing drum 19 can be shifted in one direction, is greater than or equal to the material layer thickness S of a finished winding roll 37. A secondary transport device that moves the reel during the completion of the winding process, in accordance with the diameter increase of the winding roll can be unnecessary. In this exemplary embodiment, the winding roll is thus wound in two fixed winding stations. A "fixed" winding station" is distinguished by the fact that the reel is rotatably secured in such a way that both the diameter increase of the winding roll wound on it and the adjustment of the line force in the winding nip are realized exclusively by shifting the pressing drum 19. A fixed winding station has the advantage that it offers an optimal rigidity of the reel mount so that a transmission of possibly occurring vibrations to the winding roll 37 can be practically ruled out. Since the shifting path of the pressing drum 19 is so great that the diameter increase can be completely compensated for, a constant reel tracking is not required, such that the design of the winding machine can be simplified.

It is common to all the exemplary embodiments of the winding machine that in order to prepare for a reel change, an intermediary space/a nip is formed between the almost finished winding roll 37 and the pressing drum 19. As a result, it can be assured that before the reel change, the material web 3 is already guided over a circumference region of the empty reel, which is disposed in the reel-changing position. As a result, a high degree of functional reliability can be assured.

It is furthermore advantageous that as a result of the stationary, rotatable securing of the new reel 49 at the beginning of the winding process in the primary transport device, an adjusting device of the kind that is frequently used in known winding machines can be eliminated. This adjusting device is employed to move the reel that is guided by the primary transport device radially in the direction of the pressing drum in order to adjust the line force in the winding nip. Because of this advantageous embodiment, an additional control/regulation for the adjusting device can be omitted so that the costs of the winding machine are reduced.

It is common to all the exemplary embodiments of the winding machine that the control/regulation of the line force in the winding nip can, according to the invention, be exclusively carried out during the entire winding process by a single device, namely by shifting of the pressing drum 19 with the aid of the pressing device 25.

It is furthermore particularly advantageous that existing, i.e. already assembled winding machines can be retrofitted so that one of the above-described processes for winding the material web 3 can be realized.

Alternatively to the reel, the winding machine can be equipped with a winding core to which a winding sleeve or a number of winding sleeves are attached. In the latter case, the winding machine can be preceded by a longitudinal cutting device. This cuts the web into a number of partial webs, wherein each partial web is wound onto a winding sleeve.

What is claimed:

1. A process for winding of a material web, comprising:

forming a first nip between a movable pressing drum and a first reel, said first reel being rotatably mounted on a secondary transport device, and said secondary transport device defining at least a main winding position;

moving said material web through said first nip;

winding said material web about said first reel to form a first winding roll;

controlling a line force between said moveable pressing drum and said second reel by shifting said moveable pressing drum;

moving said secondary transport device away from the moveable pressing drum as more of the web is wound on the first winding roll;

moving said secondary transport device to open said first nip such that said material web runs freely from said pressing drum to said winding roll;

rotating a second reel at a speed corresponding to a speed of movement of said material web;

forming a second nip by moving said second reel via a primary transport device into contact with said pressing drum, such that said material web is interposed therebetween;

cutting said material web so that a new web beginning can thereafter be wound onto said second reel;

winding the new web beginning of said material web onto said second reel to form a second winding roll; and transferring said second reel to the main winding position on said secondary transport device for continued winding.

2. The process of claim 1, further comprising controlling a line force between said pressing drum and said first reel by shifting said pressing drum.

3. The process of claim 1, further comprising compensating for an increase in diameter of said first winding roll.

4. The process of claim 3, wherein said compensation includes horizontally shifting said secondary transport device.

5. The process of claim 1, further comprising forming said second nip by relative movement of said pressing drum in relation to said second reel.

6. The process of claim 1, further comprising forming said first nip by relative movement of the first reel with respect to said pressing drum.

7. The process of claim 6, wherein during the opening of said first nip, said pressing drum moves with said first winding roll until said pressing drum reaches a stop, and wherein during said moving, said second reel forces said pressing drum away from said stop.

8. The process of claim 5, wherein said second nip is located in a position above a position where said secondary transport device receives said second winding roll.

9. The process of claim 8, wherein said second nip is located in a pressing plane defined by the longitudinal axes of said second reel and said pressing drum, said plane being inclined in relation to a travel path of the secondary transfer device by an angle that lies between approximately 5° and approximately 40°.

10. The process of claim 9, wherein said angle is preferably between approximately 10° and approximately 35°.

11. The process of claim 9, wherein said angle is between approximately 15° and approximately 30°.

12. The process of claim 1, wherein said secondary transport device receives said second reel at said main winding position.

13. The process of claim 1, wherein the opening of said first nip further comprises pressing a pressing element against a circumference of said winding roll.

14. The process of claim 12, further comprising guiding said material web over said second reel when disposed in said main winding position.

15. The process according to claim 1, further comprising continuously shifting said secondary transport device to compensate for an increase in diameter of said first winding roll.

16. The process of claim 1, wherein a shifting speed of said second reel as guided by said primary transport device is one of constant and variable.

17. The process of claim 1, wherein a shifting speed of the first reel as guided by said secondary transport device is one of constant or a variable.

18. The process of claim 1, wherein said web is one of paper and cardboard web.

19. A winding machine for winding of a material web, comprising:

a first reel mounted on a secondary transport device that guides said first reel along a second path, said secondary transport device defining at least a main winding position;

a first nip formed by a movable pressing drum and said first reel;

a second reel mounted on a primary transport device for guiding the second reel along a primary transport path, said primary transport device being moveable between at least a second nip position and the main winding position;

wherein said second reel moves along a first guide track for transferring said second reel to said secondary transport device after a portion of said material web has been wound around said second reel;

wherein at least said second nip position and said main winding position are each defined by contact between said second reel and the pressing drum, with said material web interposed therebetween; and wherein a second nip is formed at said second nip position prior to said second reel moving to said main winding position, such that the material web is guided over a portion of the circumference of said second reel.

20. The winding machine of claim 19, wherein said second nip position is provided above a position in which said second reel connects with said secondary transport device.

21. The winding machine of claim 19, wherein a longitudinal axis of said second reel and a longitudinal axis of said pressing drum define a pressing plane P when said second reel is in said second nip position, said plane P being inclined in relation to a horizontal plane of said winding machine by an angle between approximately 5° and approximately 40°.

22. The winding machine of claim 21, wherein said angle is between approximately 10° and approximately 35°.

23. The winding machine of claim 21, wherein said angle is between approximately 15° and 30°.

24. The winding machine of claim 19, further comprising a pressing device that moves said pressing drum, wherein said pressing device is moved to compensate for an increase in diameter of at least one of said first and second reels, as well as controlling a line force between said pressing drum and said at least one of said first and second reels.

25. The winding machine of claim 19, wherein said secondary transport device moves away from said pressing drum to compensate for an increase in diameter of at least one of said first and second reels and said material web is wound thereby.

26. The winding machine of claim 19, wherein said second nip is defined between said pressing drum and said second reel by relative movement of said second reel in relation to said pressing drum.

27. The winding machine of claim 19, wherein said pressing drum is rotatably mounted on a guide block, said guide block being movable in at least one of a direction parallel to a horizontal axis of said winding machine and a direction inclined to said horizontal axis by an angle.

28. The winding machine of claim 19, further comprising a drive that drives said pressing drum.

29. The winding machine of claim 19, further comprising a second drive for driving said secondary transport device, said second drive being able to drive and brake said secondary transport device.

30. The winding machine of claim 19, further comprising a stroke device for controllably moving said secondary transport device which is controlled as a function of an increase in relative diameter of one of said first and second reels.

31. The winding machine of claim 30, wherein said stroke device is controlled independently of a line force acting between said pressing drum and one of said first and second reels.

32. The winding machine of claim 31, further comprising a pressing device for said pressing drum, said pressing device controlling said line force.

33. The winding machine of claim 32, wherein said pressing device controls said line force independently from said stroke device.

34. The winding machine of claim 33, wherein the pressing device is controlled by a regulating device such that said line force is substantially constant.

35. The winding machine of claim 19, wherein a position of said first nip between said pressing drum and said first reel is constant.

36. The winding machine of claim 19, wherein a position of said first nip between said pressing drum and said first reel shifts with increasing roll diameter during winding.

37. The winding machine of claim 36, wherein said first nip shifts during the winding process but remains within a range of from approximately 50 mm to approximately 20 mm.

38. The winding machine of claim 32, wherein said pressing device is a hydraulic piston unit.

39. The winding machine of claim 38, wherein a maximal stroke of said piston unit is less than half the material thickness layer of a finished winding roll.

40. The winding machine of claim 39, wherein said pressing drum is a deflection adjusting roll having a jacket supported on a stationary yoke by a plurality of support elements.

41. The winding machine of claim 40, wherein said plurality of support elements are individually controllable.

42. The winding machine of claim 41, wherein said plurality of support elements act in a direction towards said first nip.

43. The winding machine of claim 41, wherein said yoke can be pivoted such that a direction in which said plurality of support elements act follows movement of said first nip.

44. The winding machine of claim 19, wherein said primary transport device includes a securing device for securing said second reel, said securing device being moveable on a set of rails.

45. The winding machine of claim 14, wherein said set of rails is disposed in one of vertically or inclined relation, by an angle, relative to a vertical plane.

46. The winding machine of claim 19, further comprising a pressing element that can be pressed against a circumference of said first winding roll.

47. The winding machine of claim 21, wherein said angle is adjustable.

48. The winding machine of claim 19, wherein said web is one of paper and cardboard web.

49. The winding machine of claim 19, wherein the first guide track defines one of a curved course, an arc-shaped course, and a linear course.

50. A winding machine for winding of a material web, comprising:

a first reel mounted on a secondary transport device that guides said first reel along a second path, said secondary transport device defining at least a main winding position;

a first nip formed by a movable pressing drum and said first reel;

a first drive for rotating said pressing drum;

a second drive for moving said secondary transport device towards and away from said pressing drum;

a pressing device for moving said pressing drum;

a guide block for mounting said pressing drum;

a second reel mounted on a primary transport device for guiding said second reel along a primary transport path, said primary transport device being moveable between at least a second nip position and said main winding position;

a primary drive for rotating the second reel on the primary transport device;

a secondary drive for rotating the first reel on the secondary transport device;

wherein at least said second nip position and said main winding position are each defined by contact between said second reel and said pressing drum, with said material web interposed therebetween; and wherein a second nip is formed at said second nip position prior to said second reel moving to said main winding position, such that said material web is guided over a portion of the circumference of said second reel.

51. A process for winding of a material web, comprising:

forming a first nip between a movable pressing drum and a first reel, said first reel being rotatably mounted on a secondary transport device, and said secondary transport device defining at least a main winding position;

moving said material web through said first nip;

winding said material web about said first reel to form a first winding roll;

controlling a line force between said moveable pressing drum and said second reel by shifting said moveable pressing drum;

moving said secondary transport device to open said first nip such that said material web runs freely from said pressing drum to said winding roll;

rotating a second reel at a speed corresponding to a speed of movement of said material web;

forming a second nip at a location other than the main winding position by moving said second reel via a primary transport device into contact with said pressing drum, such that said material web is interposed therebetween;

cutting said material web so that the web can thereafter be wound onto said second reel;

winding said material web onto said second reel to form a second winding roll; and transferring said second reel to the main winding position on said secondary transport device for continued winding.

52. A process for winding of a material web, comprising:

forming a first nip between a movable pressing drum and a first reel such that the first nip is formed by relative movement of a first reel with respect to said pressing drum, said first reel being rotatably mounted on a secondary transport device, and said secondary transport device defining at least a main winding position;

moving said material web through said first nip;

winding said material web about said first reel to form a first winding roll;

moving said secondary transport device to open said first nip such that said material web runs freely from said pressing drum to said winding roll;

rotating a second reel at a speed corresponding to a speed of movement of said material web;

forming a second nip at a location other than the main winding position by moving said second reel via a primary transport device into contact with said pressing drum, such that said material web is interposed therebetween;

cutting said material web to define a new web beginning;

winding the new web beginning said material web onto said second reel to form a second winding roll; and transferring said second reel to the main winding position on said secondary transport device for continued winding, wherein during the opening of said first nip, said pressing drum moves with said first winding roll until said pressing drum reaches a stop, and wherein during said moving, said second reel forces said pressing drum away from said stop.

53. A winding machine for winding of a material web, comprising:

a first reel mounted on a secondary transport device that guides said first reel along a second path, said secondary transport device defining at least a main winding position;

a first nip formed by a movable pressing drum and said first reel;

a second reel mounted on a primary transport device for guiding the second reel along a primary transport path, said primary transport device being moveable between at least a second nip position and the main winding position; and a stroke device for controllably moving said secondary transport device which is controlled as a function of an increase in relative diameter of one of said first and second reels, wherein at least said second nip position and said main winding position are each defined by contact between said second reel and the pressing drum, with said material web interposed therebetween;

wherein a second nip is formed at said second nip position prior to said second reel moving to said main winding position, such that the material web is guided over a portion of the circumference of said second reel; and wherein said stroke device is controlled independently of a line force acting between said pressing drum and one of said first and second reels.

54. The winding machine of claim 53, further comprising a pressing device for said pressing drum, said pressing device controlling said line force.

55. The winding machine of claim 54, wherein said pressing device is a hydraulic piston unit.

56. A winding machine for winding of a material web, comprising:

a first reel mounted on a secondary transport device that guides said first reel along a second path, said secondary transport device defining at least a main winding position;

a first nip formed by a movable pressing drum and said first reel;

a second reel mounted on a primary transport device for guiding the second reel along a primary transport path, said primary transport device being moveable between at least a second nip position and the main winding position;

wherein said primary transport device includes a securing device for securing said second reel, said securing device being moveable on a set of rails;

wherein at least said second nip position and said main winding position are each defined by contact between said second reel and the pressing drum, with said material web interposed therebetween; and wherein a second nip is formed at said second nip position prior to said second reel moving to said main winding position, such that the material web is guided over a portion of the circumference of said second reel.

57. A winding machine for winding of a material web, comprising:

a first reel mounted on a secondary transport device that guides said first reel along a second path, said secondary transport device defining at least a main winding position;

a first nip formed by a movable pressing drum and said first reel;

a first drive for rotating the moveable pressing drum;

a second drive for rotating the first reel;

a second reel mounted on a primary transport device for guiding the second reel along a primary transport path, said primary transport device being moveable between at least a second nip position and the main winding position;

a primary drive for rotating the second reel on the primary transport device;

wherein the primary transport device comprises pivoting levers upon which said second reel is one of rotatably mounted and rotatably secured, said pivoting levers being pivotal about an axis, said axis being substantially parallel to a longitudinal axis of said first reel;

wherein at least said second nip position and said main winding position are each defined by contact between said second reel and the pressing drum, with said material web interposed therebetween; and wherein a second nip is formed at said second nip position prior to said second reel moving to said main winding position, such that the material web is guided over a portion of the circumference of said second reel.

58. The winding machine of claim 57, wherein the axis of the pivoting levers is stationary inside said winding machine.

* * * * *